US011112099B2

(12) United States Patent
Miwa

(10) Patent No.: US 11,112,099 B2
(45) Date of Patent: Sep. 7, 2021

(54) PORTABLE LIGHTING APPARATUS

(71) Applicant: MAKITA CORPORATION, Anjo (JP)

(72) Inventor: Masao Miwa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/068,896

(22) Filed: Oct. 13, 2020

(65) Prior Publication Data

US 2021/0140614 A1 May 13, 2021

(30) Foreign Application Priority Data

Nov. 7, 2019 (JP) ..... JP2019-202511

(51) Int. Cl.

| | |
|---|---|
| ***F21V 21/14*** | (2006.01) |
| ***F21V 21/40*** | (2006.01) |
| ***F21V 21/26*** | (2006.01) |
| ***F21Y 115/10*** | (2016.01) |
| ***F21S 9/02*** | (2006.01) |

(52) U.S. Cl.

CPC ..... *F21V 21/145* (2013.01); *F21V 21/26* (2013.01); *F21V 21/40* (2013.01); *F21S 9/02* (2013.01); *F21Y 2115/10* (2016.08)

(58) Field of Classification Search

CPC .... F21V 21/145; F21V 21/0885; F21V 21/22; F21V 21/40; F21V 14/02; F21V 14/025; F21V 17/02; F21V 17/007; F21S 9/02; F21S 9/022

See application file for complete search history.

(56) References Cited

U.S. PATENT DOCUMENTS

| | | | | |
|---|---|---|---|---|
| 5,683,831 | A * | 11/1997 | Baril | A42B 3/0406 429/96 |
| 6,454,428 | B1 * | 9/2002 | Bruzon | B25G 1/04 362/119 |
| 6,625,918 | B2 * | 9/2003 | Bhullar | A01M 1/226 248/125.2 |
| 6,953,260 | B1 * | 10/2005 | Allen | F21L 4/027 362/194 |
| 8,087,797 | B2 | 1/2012 | Pelletier et al. | |
| 8,201,979 | B2 | 6/2012 | Deighton et al. | |
| 9,222,633 | B2 | 12/2015 | Inskeep | |
| 9,810,408 | B2 | 11/2017 | Fang | |
| 2005/0036308 | A1 * | 2/2005 | Wright | F21V 21/06 362/190 |

(Continued)

FOREIGN PATENT DOCUMENTS

| | | |
|---|---|---|
| JP | H07-005359 Y2 | 2/1995 |
| JP | 2007-134175 A | 5/2007 |
| JP | 2015-018784 A | 1/2015 |

*Primary Examiner* — Jong-Suk (James) Lee
*Assistant Examiner* — James M Endo
(74) *Attorney, Agent, or Firm* — Oliff PLC

(57) ABSTRACT

A user can replace a battery smoothly. A portable lighting apparatus includes a guide pipe, a pole supported on the guide pipe in a manner movable in a vertical direction parallel to a central axis of the guide pipe, at least one light emitter at an upper end of the pole, a collar surrounding the guide pipe, a plurality of legs pivotally connected to the collar, and a battery mount located in an upper part of the guide pipe.

13 Claims, 25 Drawing Sheets

(56) References Cited

U.S. PATENT DOCUMENTS

2007/0014116 A1* 1/2007 Yoshimori ..... F21V 21/36 362/386
2007/0221797 A1* 9/2007 Thompson ..... F16M 11/10 248/176.1
2007/0252067 A1* 11/2007 Lee ..... F16M 11/28 248/407
2010/0237263 A1* 9/2010 Walesa ..... F21L 4/02 250/495.1
2011/0010974 A1* 1/2011 White ..... E01F 9/692 40/606.02
2011/0122605 A1* 5/2011 Deighton ..... F16M 11/28 362/183
2012/0006719 A1* 1/2012 Celona ..... H01M 50/20 206/703
2012/0327639 A1* 12/2012 Chen ..... F21S 9/035 362/183
2013/0128565 A1* 5/2013 Cugini ..... F21L 4/02 362/184
2013/0265780 A1* 10/2013 Choksi ..... F21V 17/08 362/373
2014/0218936 A1* 8/2014 Mahling ..... F21L 14/00 362/311.01
2014/0301066 A1* 10/2014 Inskeep ..... F21S 9/02 362/183
2015/0077967 A1* 3/2015 Pellenc ..... H05B 45/00 362/20
2015/0192243 A1* 7/2015 Sharrah ..... F21L 4/00 362/190
2015/0330558 A1* 11/2015 Intravatola ..... F16M 11/28 362/184
2016/0312967 A1* 10/2016 Harvey ..... F21V 17/007
2017/0350577 A1 12/2017 Harvey et al.
2018/0031214 A1* 2/2018 Li ..... F21V 17/02
2018/0058673 A1* 3/2018 Fang ..... F21V 21/406
2018/0119935 A1* 5/2018 Proeber ..... F21V 23/001
2018/0149344 A1* 5/2018 Cornell ..... F21V 17/007
2018/0163957 A1* 6/2018 Zhou ..... F21V 21/22
2018/0180267 A1* 6/2018 Theodoro ..... F21V 21/145
2019/0055951 A1* 2/2019 Jacobs ..... H02S 40/38
2019/0093866 A1* 3/2019 Thomas ..... F21V 21/145
2019/0107263 A1* 4/2019 Adams ..... F21V 21/26
2019/0107270 A1 4/2019 Harvey et al.
2019/0158303 A1* 5/2019 Gharabegian ..... H04L 12/282

* cited by examiner

PORTABLE LIGHTING APPARATUS

CROSS-REFERENCE TO RELATED APPLICATIONS

This application claims the benefit of priority to Japanese Patent Application No. 2019-202511, filed on Nov. 7, 2019, the entire contents of which are hereby incorporated by reference.

BACKGROUND

1. Technical Field

The present disclosure relates to a portable lighting apparatus.

2. Description of the Background

A known lighting apparatus in the field of portable lighting apparatuses is supported on a tripod, as described in Japanese Unexamined Patent Application Publication No. 2015-018784.

BRIEF SUMMARY

A portable lighting apparatus with a battery mount is to allow smooth battery replacement by a user.

One or more aspects of the present disclosure are directed to a portable lighting apparatus that allows smooth battery replacement by a user.

A first aspect of the present disclosure provides a portable lighting apparatus, including:

a guide pipe;

a pole supported on the guide pipe in a manner movable in a vertical direction parallel to a central axis of the guide pipe;

at least one light emitter at an upper end of the pole;

a collar surrounding the guide pipe;

a plurality of legs pivotally connected to the collar; and a battery mount located in an upper part of the guide pipe.

The portable lighting apparatus according to the above aspect of the present disclosure allows smooth battery replacement by a user.

DETAILED DESCRIPTION

Although one or more embodiments of the present disclosure will now be described with reference to the drawings, the present disclosure is not limited to the embodiments. The components in the embodiments described below may be combined as appropriate. One or more components may be eliminated.

In the embodiments, the positional relationships between the components will be described using the directional terms such as right and left (or lateral), front and rear, and up and down (or vertical). The terms indicate relative positions or directions with respect to the center of a portable lighting apparatus 1.

The portable lighting apparatus 1 includes a guide pipe 2 that extends vertically. In the embodiments, a direction parallel to a central axis AX of the guide pipe 2 is referred to as an axial direction or axially for convenience. A direction about the central axis AX is referred to as a circumferential direction or circumferentially for convenience. A direction radial from the central axis AX is referred to as a radial direction or radially for convenience.

In the embodiments, the central axis AX extends vertically. The axial direction corresponds to the vertical direction. The axial direction is from up to down or from down to up. A position nearer the central axis AX in the radial direction, or a radial direction toward the central axis AX, is referred to as radially inside or radially inward for convenience. A position farther from the central axis AX in the radial direction, or a radial direction away from the central axis AX, is referred to as radially outside or radially outward for convenience.

Overview of Portable Lighting Apparatus

Figure 1:
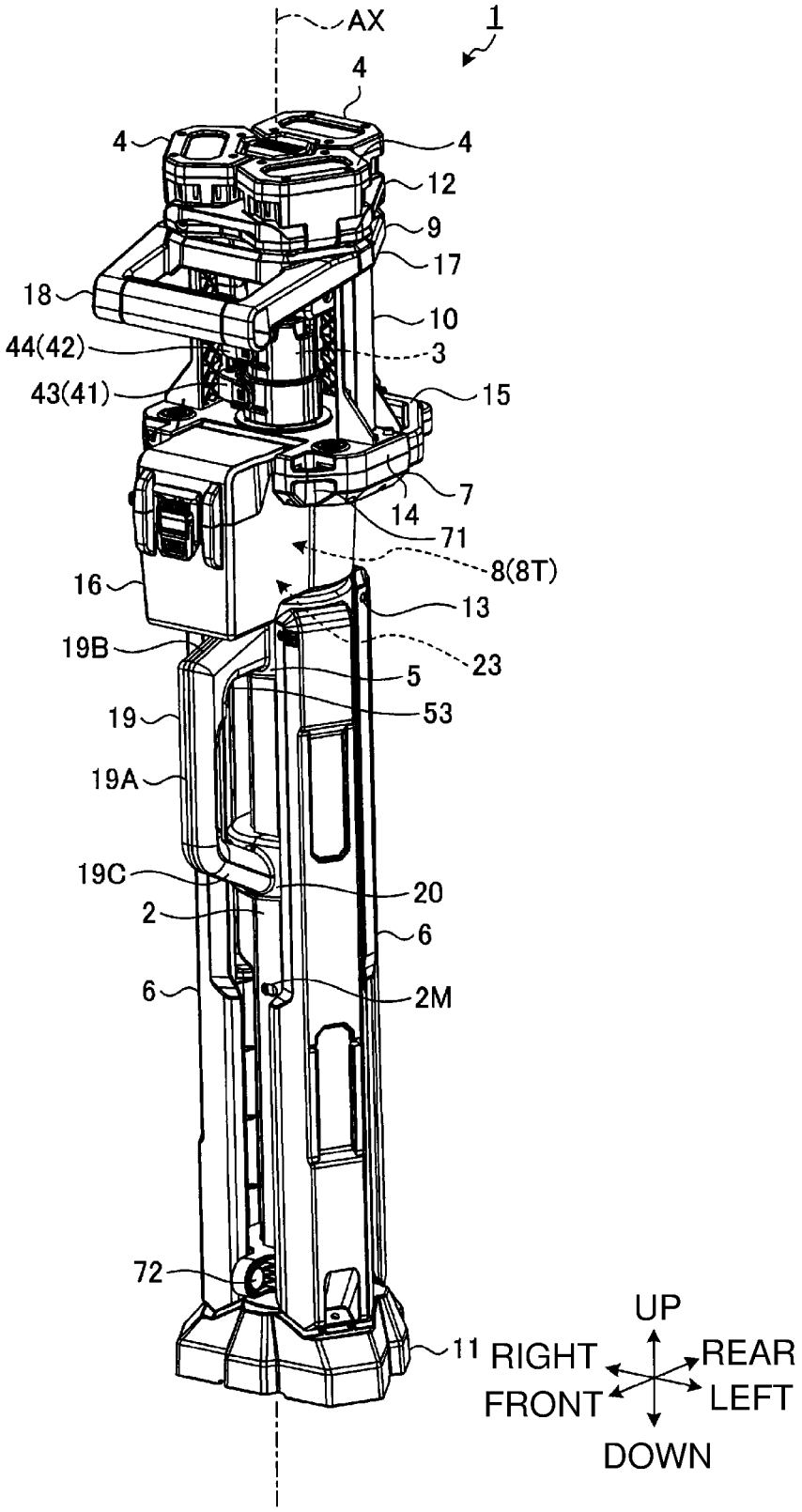
FIG. 1 is a front perspective view of a portable lighting apparatus according to an embodiment.
Figure 2:
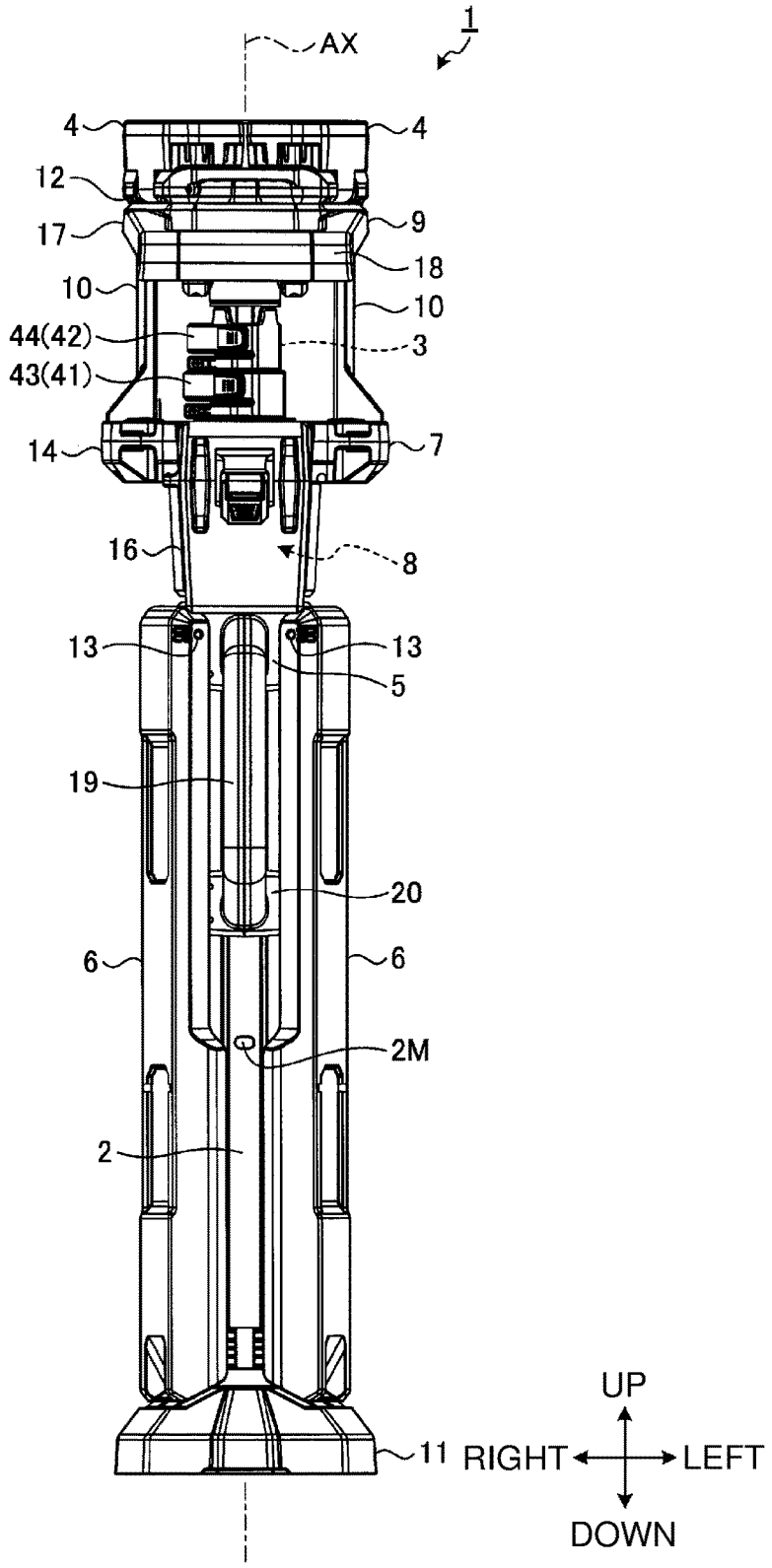
FIG. 2 is a front view of the portable lighting apparatus according to the embodiment.
Figure 3:
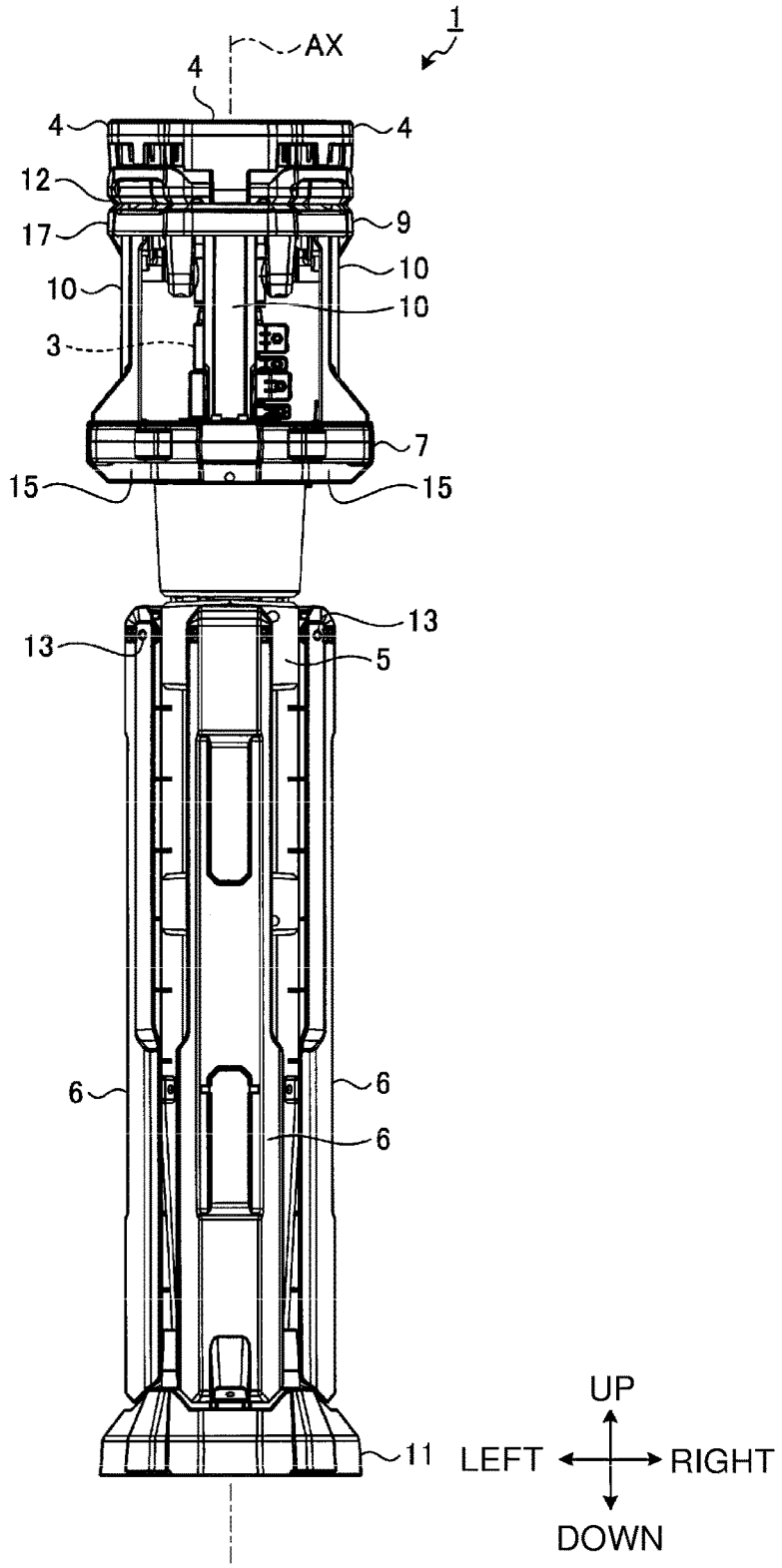
FIG. 3 is a rear view of the portable lighting apparatus according to the embodiment.
Figure 4:
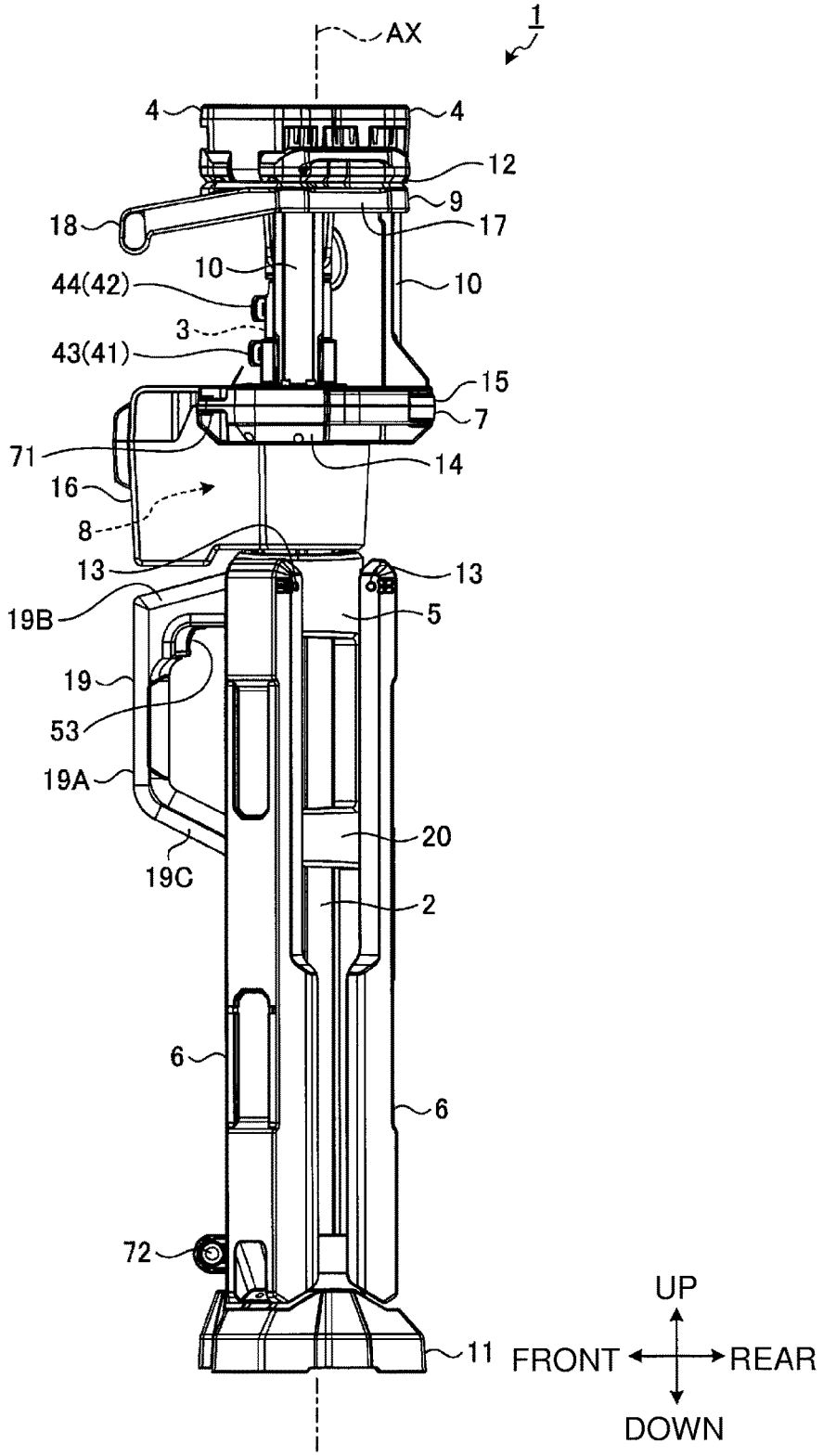
FIG. 4 is a left side view of the portable lighting apparatus according to the embodiment.
Figure 5:
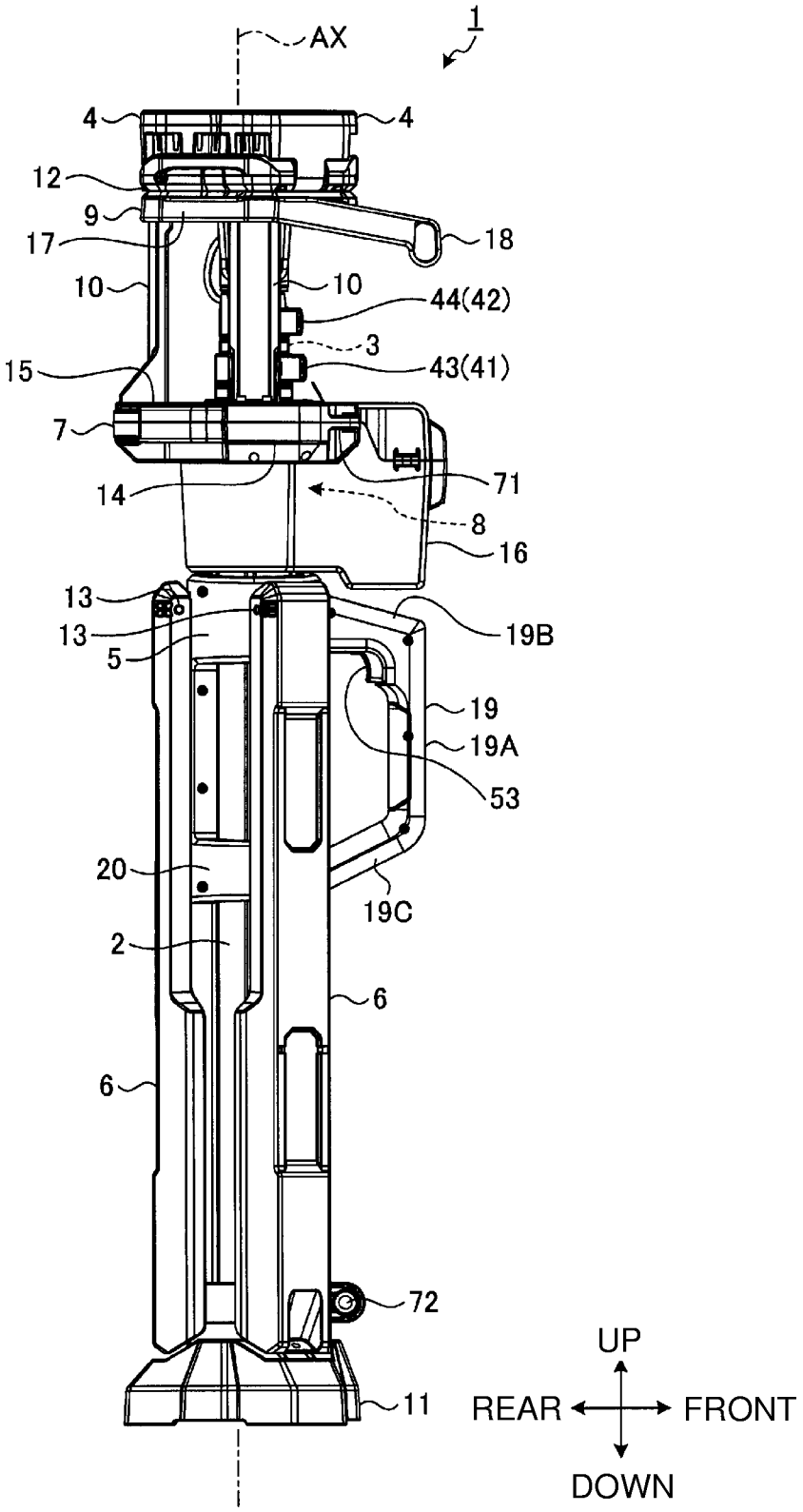
FIG. 5 is a right side view of the portable lighting apparatus according to the embodiment.

FIG. 1 is a front perspective view of the portable lighting apparatus 1 according to an embodiment. FIG. 2 is a front view of the portable lighting apparatus 1 according to the embodiment. FIG. 3 is a rear view of the portable lighting apparatus 1 according to the embodiment. FIG. 4 is a left side view of the portable lighting apparatus 1 according to the embodiment. FIG. 5 is a right side view of the portable lighting apparatus 1 according to the embodiment.

As shown in FIGS. 1 to 5, the portable lighting apparatus 1 includes the guide pipe 2, a pole 3, light emitters 4, a collar 5, legs 6, a first member 7, and a battery mount 8. The pole 3 is supported on the guide pipe 2 in a movable manner. The light emitters 4 are located at the upper end of the pole 3. The collar 5 surrounds the guide pipe 2. The legs 6 are pivotally connected to the collar 5. The first member 7 is located at the upper end of the guide pipe 2. The battery mount 8 is located at the first member 7.

The portable lighting apparatus 1 also includes a second member 9, third members 10, and a fourth member 11. The second member 9 is located above the first member 7 and surrounds the pole 3. The third members 10 connect the first member 7 and the second member 9. The fourth member 11 is located at the lower end of the guide pipe 2.

The guide pipe 2 extends vertically. The guide pipe 2 has the central axis AX that extends vertically. The vertical direction is parallel to the central axis AX of the guide pipe 2.

The pole 3 is supported on the guide pipe 2 in a vertically movable manner. The pole 3 is located at least partially in the guide pipe 2. The pole 3 is movable vertically as guided by the guide pipe 2.

The light emitters 4 emit illumination light. The portable lighting apparatus 1 includes three light emitters 4 in the embodiment. The light emitters 4 include light-emitting diodes (LEDs). The light emitters 4 are supported on a support 12 located at the upper end of the pole 3.

The collar 5 is annular and surrounds the guide pipe 2. The collar 5 is movable vertically relative to the guide pipe 2. The collar 5 is movable vertically around the guide pipe 2.

The legs 6 are pivotally connected to the collar 5. Each leg 6 has an upper end pivotally connected to the collar 5 with a hinge 13. The portable lighting apparatus 1 includes three legs 6 in the embodiment. The guide pipe 2, the collar 5, and the three legs 6 together form a tripod.

The first member 7 surrounds the guide pipe 2 at the upper end of the guide pipe 2. The first member 7 is fixed at the upper end of the guide pipe 2.

The first member 7 includes a first base 14, first handles 15, and a battery container 16. The first base 14 surrounds the upper end of the guide pipe 2. The first handles 15 are coupled to the first base 14.

The battery mount 8 is connected to a battery 23. The battery mount 8 includes a connector terminal 8T connectable to a battery terminal in the battery 23. The battery mount 8 is inside the battery container 16.

The second member 9 is located above the first member 7 and surrounds the pole 3. The second member 9 is spaced from the pole 3. The pole 3 is movable vertically inside the second member 9.

The second member 9 includes a second base 17 and a second handle 18. The second base 17 surrounds the pole 3. The second handle 18 is coupled to the second base 17.

The third members 10 are rods extending vertically. The third members 10 connect the first member 7 and the second member 9. The second member 9 is supported by the first member 7 with the third members 10 in between. The third members 10 are located circumferentially. The third members 10 are at intervals to surround the guide pipe 2. The second member 9 is supported by the first member 7 with the third members 10 in between.

Figure 6:
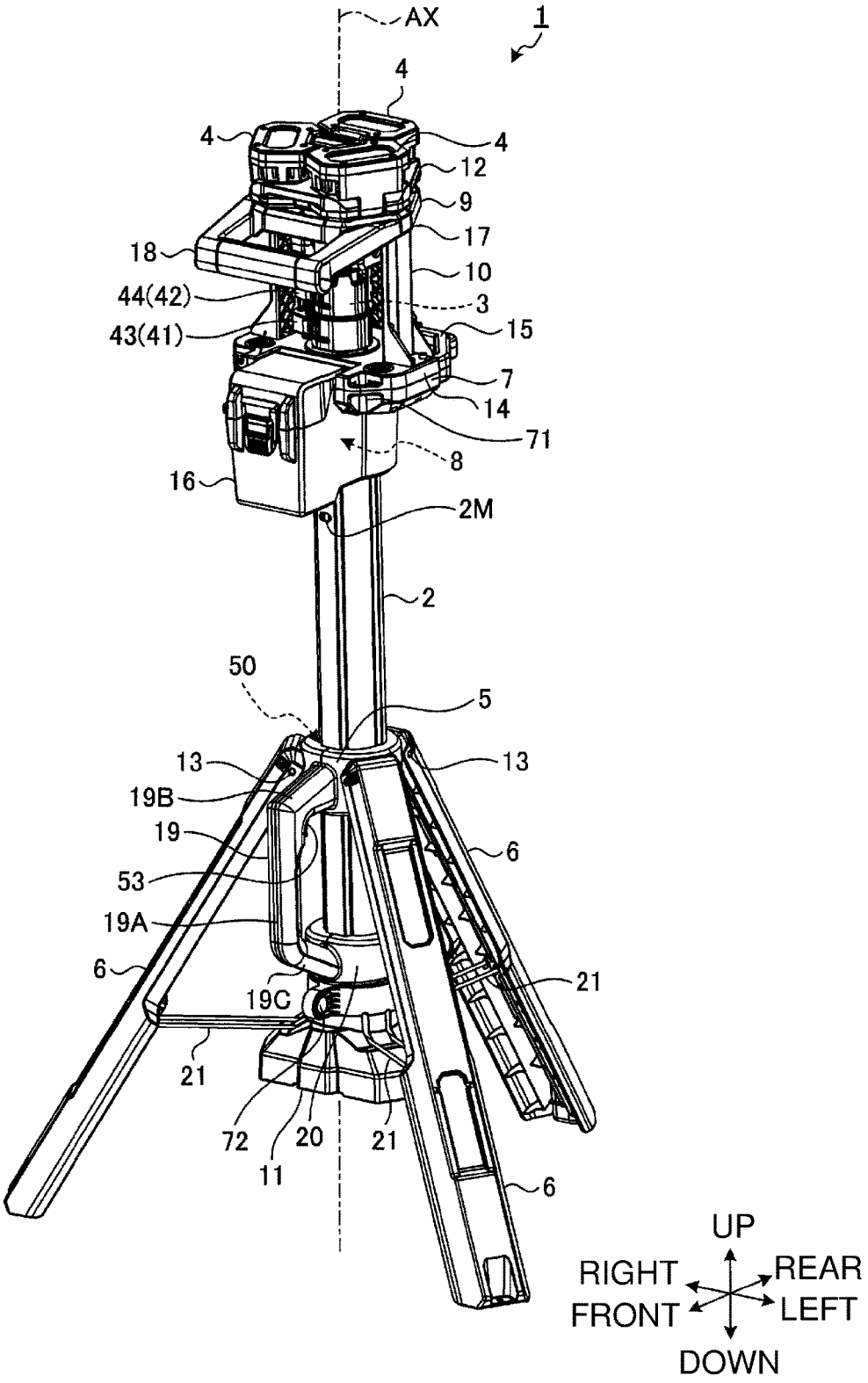
FIG. 6 is a front perspective view of the portable lighting apparatus according to the embodiment.
Figure 7:
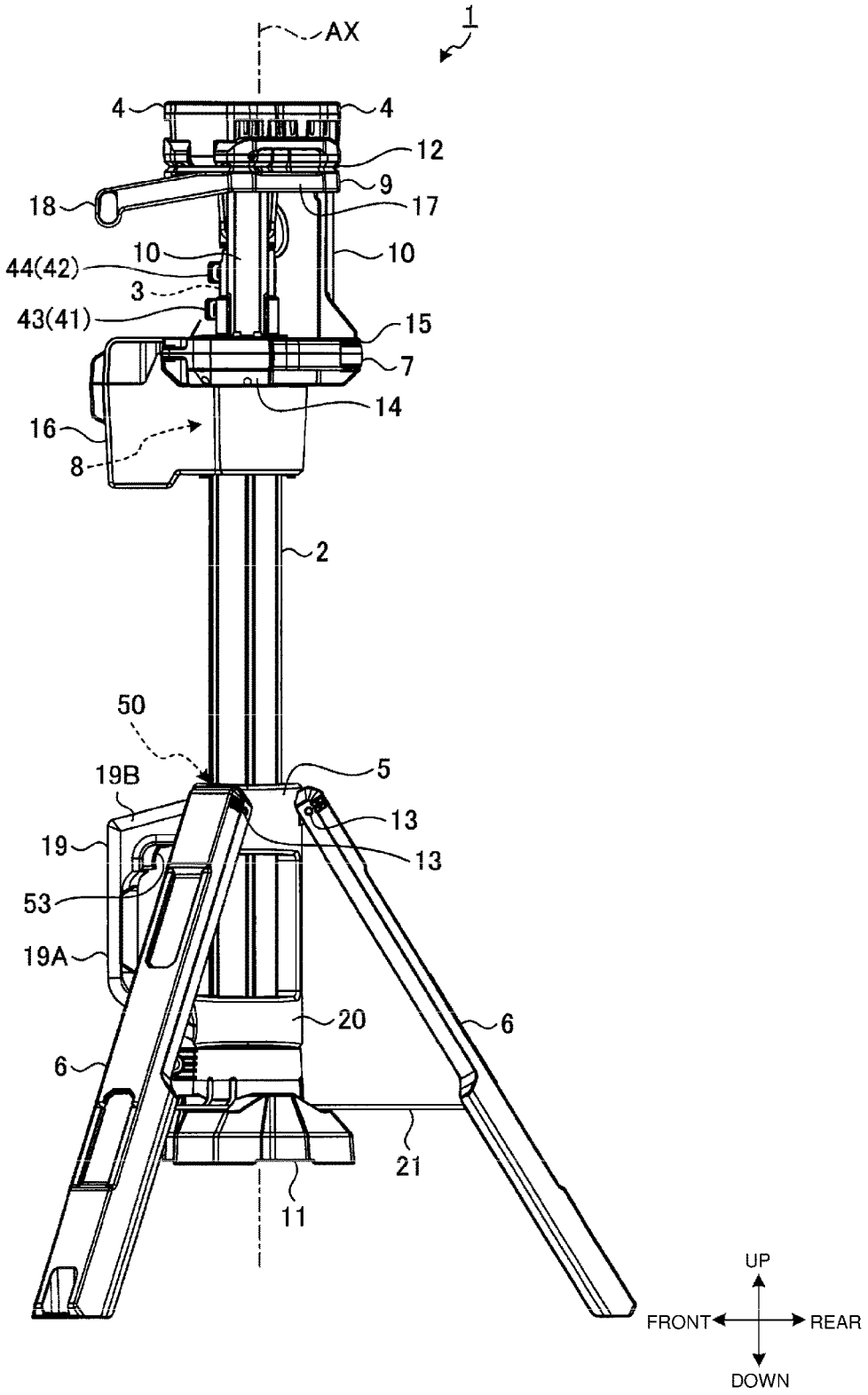
FIG. 7 is a left side view of the portable lighting apparatus according to the embodiment.

FIG. 6 is a front perspective view of the portable lighting apparatus 1 according to the embodiment. FIG. 7 is a left side view of the portable lighting apparatus 1 according to the embodiment. In FIGS. 6 and 7, the legs 6 are open.

The portable lighting apparatus 1 includes the fourth member 11, stays 21, and a third handle 19. The fourth member 11 is located at the lower end of the guide pipe 2. The stays 21 are pivotally connected to the respective legs 6 and to the fourth member 11 to allow the legs 6 to move between an open position and a closed position with the collar 5 moving relative to the guide pipe 2. The third handle 19 is coupled to the collar 5. In FIGS. 1 to 5, the legs 6 are at the closed position. In FIGS. 6 and 7, the legs 6 are at the open position.

The third handle 19 has its upper end coupled to the collar 5 and its lower end coupled to a collar 20. The collar 20 is annular. The collar 20 surrounds the guide pipe 2. The collar 20 is located below the collar 5. The collar 20 is movable vertically relative to the guide pipe 2. The collar 20 is movable vertically around the guide pipe 2.

The third handle 19 includes a grip 19A, an arm 19B, and an arm 19C. The grip 19A extends vertically. The arm 19B connects the upper end of the grip 19A to the collar 5. The arm 19C connects the lower end of the grip 19A to the collar 20. The arm 19B extends radially outside the collar 5. The arm 19C extends radially outside the collar 20. The third handle 19 defines a space with the guide pipe 2. A user places his or her hand in the space between the guide pipe 2 and the third handle 19 and holds the third handle 19.

The collar 5, the third handle 19, and the collar 20 are integral with one another. The collar 5, the third handle 19, and the collar 20 move together vertically relative to the guide pipe 2.

The portable lighting apparatus 1 includes as many stays 21 as the legs 6. The portable lighting apparatus 1 includes three stays 21 in the embodiment. The stays 21 are connected to the respective legs 6 and to the fourth member 11. Each stay 21 has its outer end pivotally connected to the leg 6 and its inner end pivotally connected the fourth member 11. The collar 5, the fourth member 11, the stays 21, and the legs 6 form a link assembly.

At the closed position of the legs 6, the stays 21 extend vertically. At the open position of the legs 6, the stays 21 extend radially.

When the collar 5 moves downward relative to the guide pipe 2, as shown in FIGS. 6 and 7, the stays 21 extending axially extend radially. Each stay 21 has its inner end pivotable relative to the fourth member 11 and its outer end pivotable relative to the leg 6. Each stay 21 pushes the leg 6 radially outward, placing the leg 6 at the open position.

When the collar 5 moves upward relative to the guide pipe 2, as shown in FIGS. 1 to 5, the stays 21 extending radially extend axially. Each stay 21 has its inner end pivotable relative to the fourth member 11 and its outer end pivotable relative to the leg 6. Each stay 21 retracts the leg 6 radially inward, placing the leg 6 at the closed position.

Figure 8:
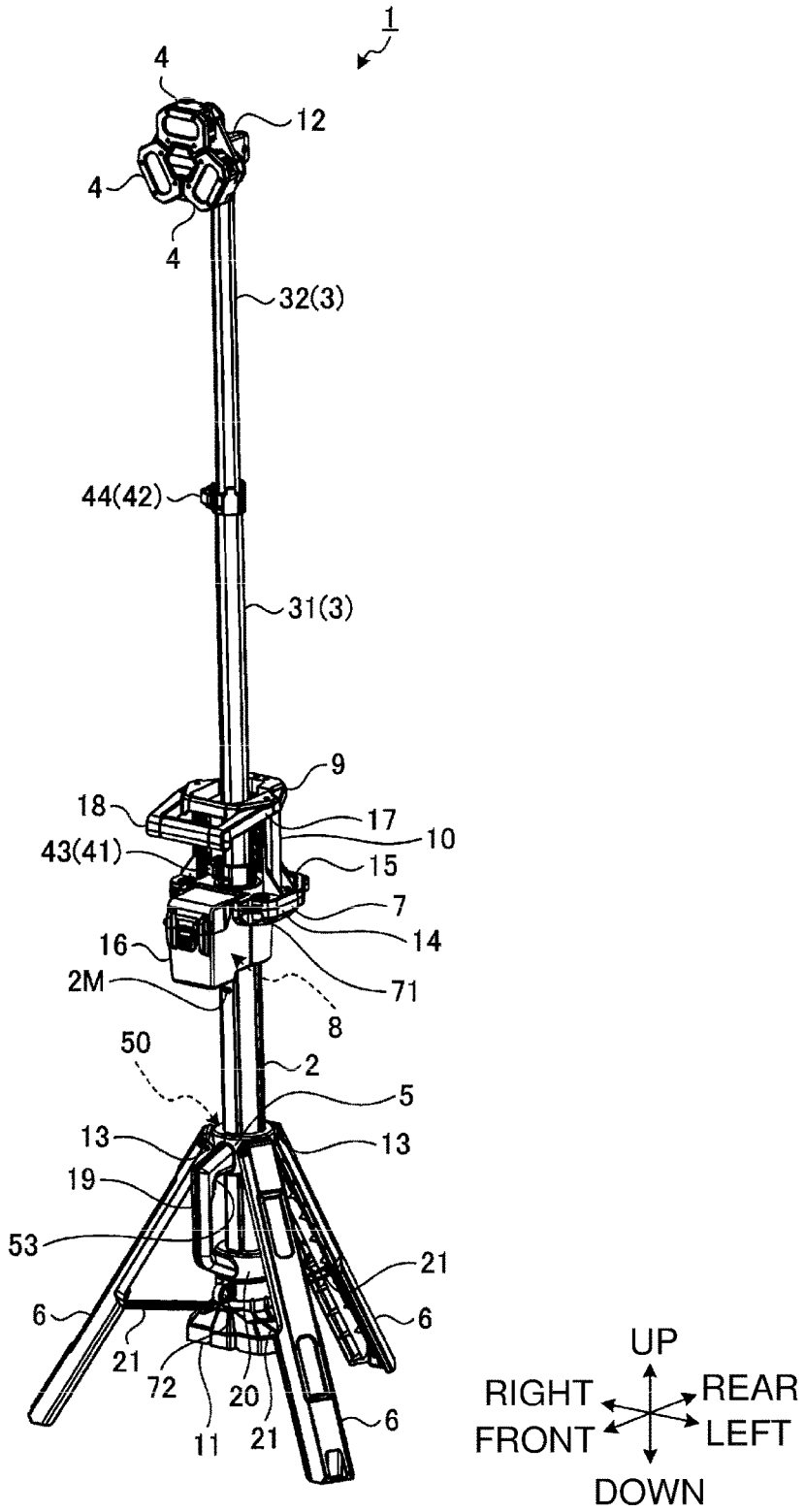
FIG. 8 is a front perspective view of the portable lighting apparatus according to the embodiment.

FIG. 8 is a front perspective view of the portable lighting apparatus 1 according to the embodiment. In FIG. 8, the legs 6 are at the open position, and the pole 3 is moved upward.

The pole 3 includes a first pole 31 and a second pole 32. The first pole 31 is supported on the guide pipe 2 in a vertically movable manner. The second pole 32 is supported on the first pole 31 in a vertically movable manner. The pole 3 extends and contracts as the first pole 31 moves relative to the guide pipe 2 and the second pole 32 moves relative to the first pole 31.

The light emitters 4 and the support 12 supporting the light emitters 4 are located at the upper end of the second pole 32. As the pole 3 extends or contracts, the light emitters 4 are moved to different heights.

First Member, Second Member, and Third Member

Figure 9:
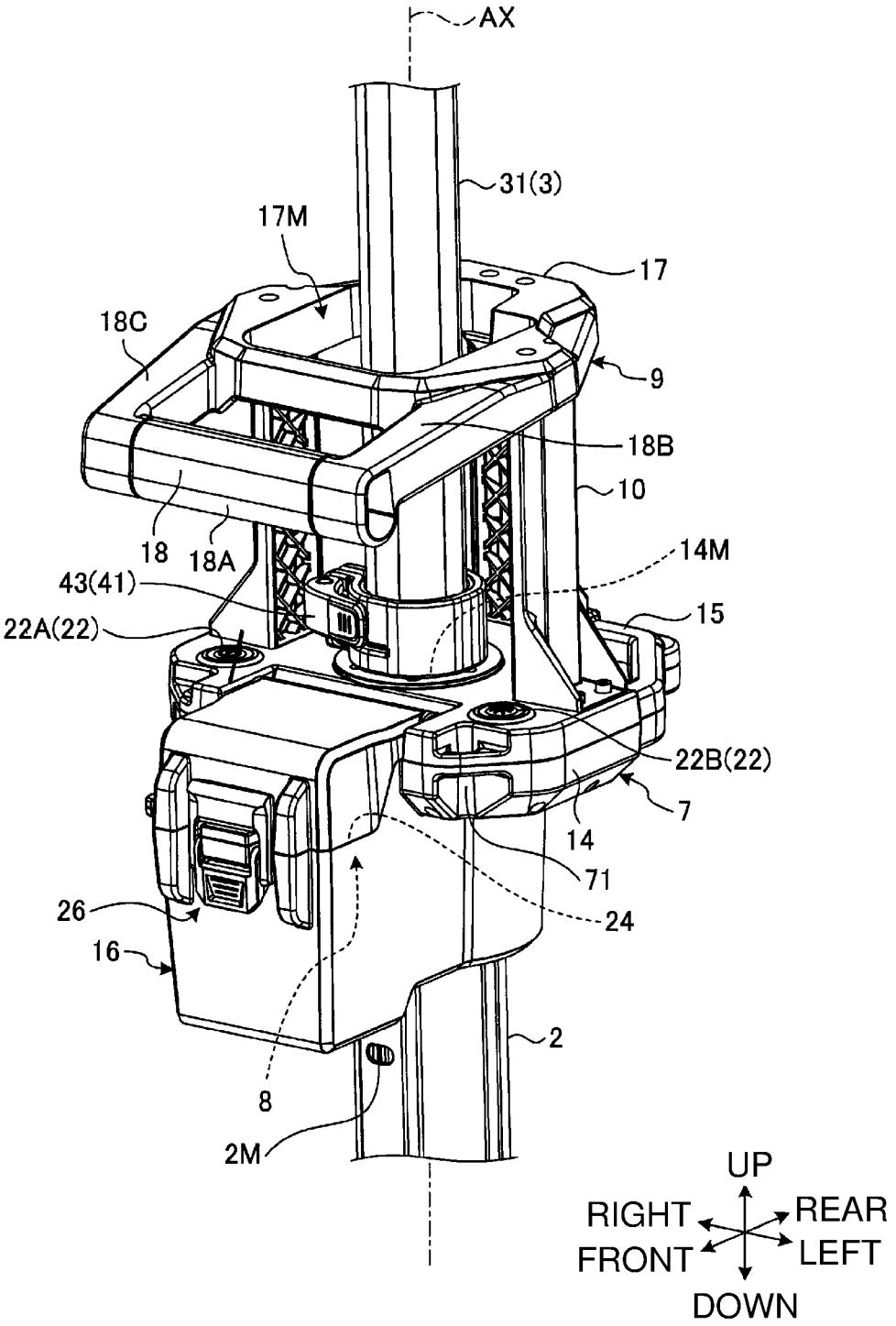
FIG. 9 is a partial front perspective view of the portable lighting apparatus according to the embodiment.

FIG. 9 is a partial front perspective view of the portable lighting apparatus 1 according to the embodiment. As shown in FIG. 9, the first member 7 includes the first base 14, the first handles 15, and the battery container 16. The first base 14 surrounds the guide pipe 2. The first handles 15 are coupled to the first base 14. The battery container 16 is coupled to the first base 14. The battery mount 8 is inside the battery container 16.

The first base 14 has an opening 14M receiving the guide pipe 2. The first base 14 is fixed at the upper end of the guide pipe 2.

The first handles 15 are coupled to a first portion of the first base 14 circumferentially about the central axis AX of the guide pipe 2. In the embodiment, two first handles 15 are located at the rear of the first base 14. The two first handles 15 are arranged laterally. The first handles 15 are rods extending on a plane orthogonal to the central axis AX. The first handles 15 in the embodiment are arc-shaped. Each first handle 15 has its two ends coupled to the first base 14.

The first handles 15 are integral with the first base 14. Each first handle 15 defines a space with the first base 14. The user may place his or her hands in the spaces between the first base 14 and the first handles 15 and hold the first handles 15. As shown in FIG. 3, the first member 7 includes two first handles 15, which allow the user to grip one first handle 15 with one hand and the other first handle 15 with the other hand.

The battery container 16 (battery mount 8) is coupled to a second portion of the first base 14 opposite to the first portion circumferentially about the central axis AX of the guide pipe 2. In the embodiment, the battery container 16 is located at the front of the first base 14. The battery container 16 includes a case. The battery container 16 is integral with the first base 14. The battery mount 8 is inside the battery container 16. The battery mount 8 is located at the front of the first base 14.

The second member 9 includes the second base 17 and the second handle 18. The second base 17 surrounds the pole 3. The second handle 18 is coupled to the second base 17.

The second base 17 has an opening 17M to receive the pole 3. The second base 17 is not in contact with the pole 3. The second base 17 has its inner surface facing the outer surface of the pole 3 across a space. The pole 3 is movable vertically inside the second base 17.

The second handle 18 is located at the front of the second base 17. In the embodiment, the second handle 18 includes a grip 18A, an arm 18B, and an arm 18C. The grip 18A, the arm 18B, and the arm 18C are rods extending on a plane orthogonal to the central axis AX. The grip 18A extends laterally. The arm 18B and the arm 18C extend in the front-rear direction. The arm 18B connects the left end of the grip 18A to the second base 17. The arm 18C connects the right end of the grip 18A to the second base 17.

The second handle 18 is integral with the second base 17. The second handle 18 defines a space with the second base 17. The user places his or her hand in the space between the second base 17 and the second handle 18 and holds the second handle 18.

In the embodiment, the second handle 18 is located above the battery container 16 including the battery mount 8.

The third members 10 connect the first member 7 and the second member 9. The second member 9 is supported by the first member 7 with the third members 10 in between. The third members 10 are rods extending vertically along the central axis AX. Each third member 10 has its lower end coupled to the upper surface of the first base 14 and its upper end coupled to the lower surface of the second base 17.

The third members 10 are arranged circumferentially. As shown in FIG. 3, three third members 10 are arranged circumferentially. The third members 10 are at intervals to surround the guide pipe 2 and the pole 3. The third members 10 define spaces between adjacent third members. The user places his or her hand into the space between adjacent third members 10 and holds one third member 10. The third members 10 serve as handles.

The user can lift or carry the portable lighting apparatus 1 by gripping at least one of the first handles 15, the second handle 18, the third handle 19, or the third members 10.

The first member 7 includes an operation device 22 operable to adjust the light emitters 4. The operation device 22 includes an on-off switch 22A and a light amount adjustment switch 22B. The on-off switch 22A is operable to turn on and off the light emitters 4. The light amount adjustment switch 22B is operable to adjust the amount of illumination light emitted from the light emitters 4.

Battery Container

Figure 10:
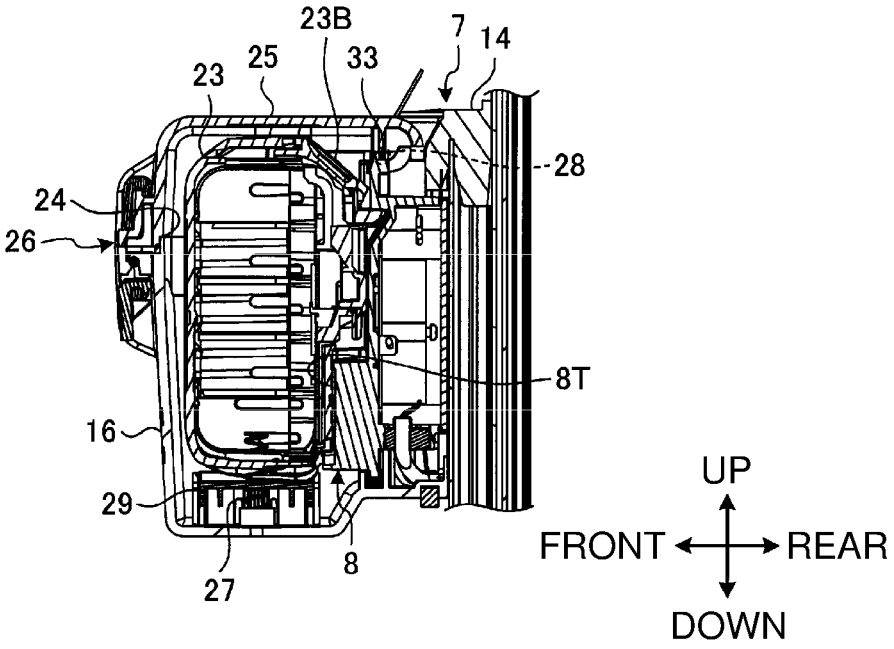
FIG. 10 is a sectional view of a battery container in the embodiment.

FIG. 10 is a sectional view of the battery container 16 in the embodiment. The battery container 16 accommodates the battery 23. The battery 23 is a battery for power tools. The battery mount 8 is inside the battery container 16. The battery 23 is attached to the battery mount 8. The battery mount 8 includes the connector terminal 8T connectable to the battery terminal in the battery 23. With the battery terminal connected to the connector terminal 8T, the battery 23 supplies power to the portable lighting apparatus 1.

The battery container 16 has an opening 24 to receive the battery 23. The opening 24 is at the upper end of the battery container 16. The battery 23 to be attached to or detached from the battery mount 8 is placed through the opening 24.

The portable lighting apparatus 1 includes a cover 25 pivotally connected to the first member 7 to close the opening 24. The cover 25 is pivotally connected to the first base 14 with a hinge 33. The cover 25 reduces foreign objects, such as liquid, entering the battery container 16.

The cover 25 is fastened to the battery container 16 with a fastener 26, such as a latch. The fastener 26 restricts rotation of the cover 25 that closes the opening 24.

The battery mount 8 includes a guide that guides the battery 23 vertically. As guided vertically by the guide on the battery mount 8, the battery 23 is attached to or detached from the battery mount 8.

To attach the battery 23 to the battery mount 8, the user opens the opening 24 and places, from above the battery container 16, the battery 23 into the battery container 16 through the opening 24. The user moves the battery 23 downward while placing the battery 23 in contact with the battery mount 8. The battery 23 is attached to the battery mount 8 in this manner. The battery 23 is fixed to the battery mount 8. With the battery 23 fixed to the battery mount 8 and the battery terminal in the battery 23 connected to the connector terminal 8T in the battery mount 8, the battery 23 supplies power to the portable lighting apparatus 1. After the battery 23 is attached to the battery mount 8, the cover 25 closes the opening 24.

To detach the battery 23 from the battery mount 8, the user opens the opening 24 and operates a release button 23B in the battery 23. This releases the battery 23 fixed to the battery mount 8. The user then moves the battery 23 upward to detach the battery 23 from the battery mount 8. The battery 23 detached from the battery mount 8 is removed out of the battery container 16 through the opening 24. The cover 25 then closes the opening 24.

The portable lighting apparatus 1 includes a first elastic member 27. The first elastic member 27 applies an elastic force to the battery 23 and causes the battery 23 detached from the battery mount 8 to protrude from the battery container 16 through the opening 24. The first elastic member 27 is, for example, a coil spring.

The first elastic member 27 is inside the battery container 16. The first elastic member 27 is supported on the bottom surface of the battery container 16. The battery container 16 has a support plate 29 inside. The support plate 29 supports the battery 23 accommodated in the battery container 16 from below. The support plate 29 comes in contact with at least a portion of the battery 23 accommodated in the battery container 16.

The first elastic member 27 is between the support plate 29 and the bottom surface of the battery container 16. The first elastic member 27 applies an elastic force to the battery 23 through the support plate 29.

As shown in FIG. 10, with the battery 23 fixed to the battery mount 8, the battery 23 presses the support plate 29 from above. This compresses the first elastic member 27.

Figure 11:
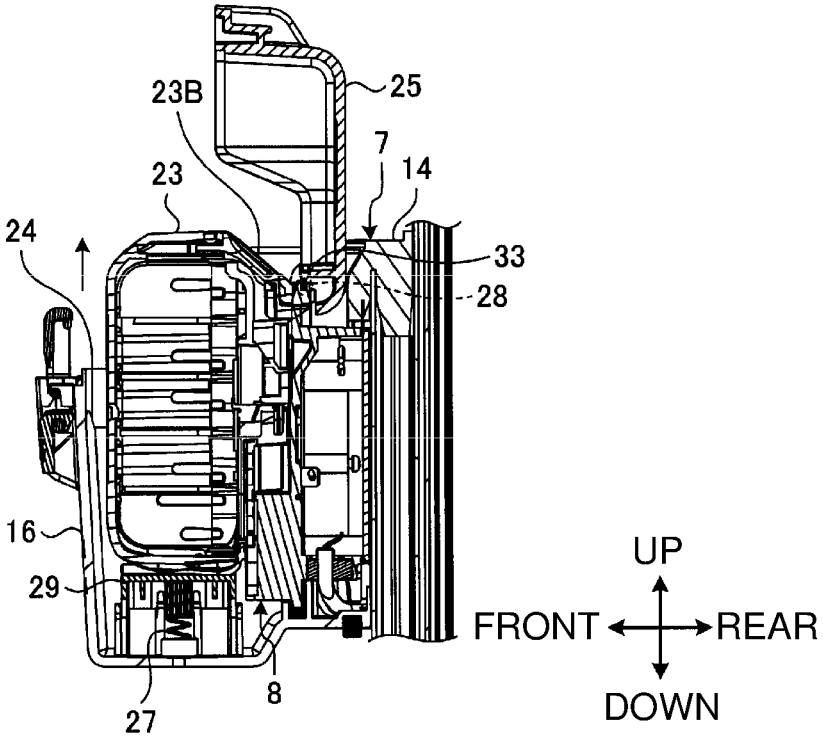
FIG. 11 is a sectional view of the battery container in the embodiment.

FIG. 11 is a sectional view of the battery container 16 in the embodiment. FIG. 11 shows the battery container 16 with the opening 24 being open and the release button 23B in the battery 23 being operated to detach the battery 23 from the battery mount 8.

When the release button 23B is operated to release the battery 23 fixed to the battery mount 8, the elastic force from the first elastic member 27 moves the support plate 29 and the battery 23 toward the opening 24. The battery 23 springs up with the elastic force from the first elastic member 27. The battery 23 then at least partially protrudes from the opening 24. The user can easily grip the battery 23 detached from the battery mount 8.

The portable lighting apparatus 1 includes a second elastic member 28. The second elastic member 28 applies an elastic force to the cover 25 to close the opening 24. The second elastic member 28 is, for example, a torsion spring.

The second elastic member 28 surrounds the hinge 33. The second elastic member 28 applies an elastic force to the cover 25 through the hinge 33 to allow the cover 25 to close the opening 24. The cover 25 is, for example, held by the user with one hand to remain open.

Figure 12:
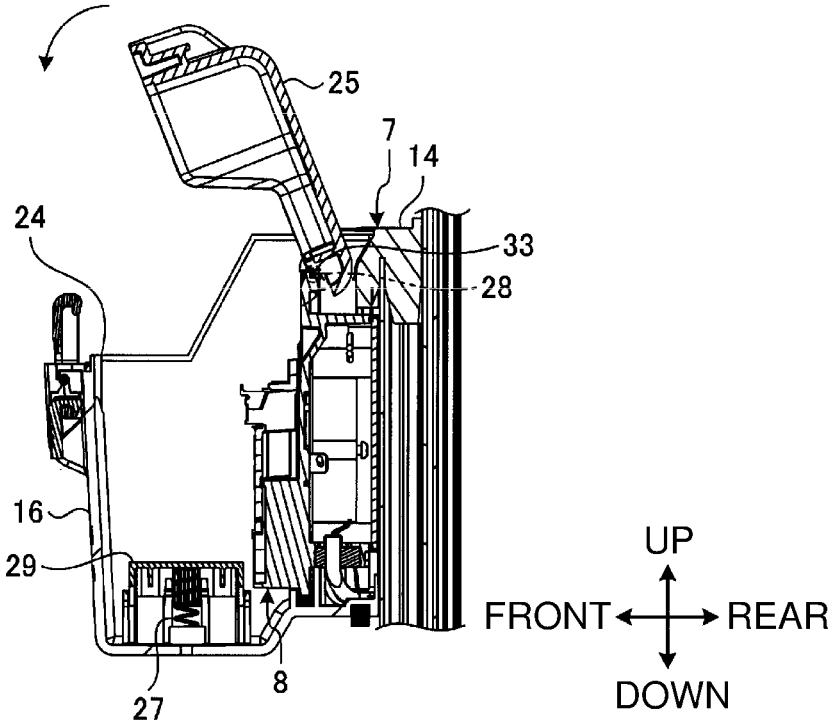
FIG. 12 is a sectional view of the battery container in the embodiment.

FIG. 12 is a sectional view of the battery container 16 in the embodiment. FIG. 12 shows the battery container 16 for which the battery 23 has been removed from the battery mount 8 and the user has released his or her hand from the cover 25.

When the user releases the hand from the cover 25, the cover 25 pivots with the elastic force from the second elastic member 28 to close the opening 24. The cover 25 then closes the opening 24. The cover 25 thus reduces foreign objects entering the battery container 16. When, for example, the user forgets to close the opening 24 with the cover 25, the opening 24 is closed by the cover 25 with the elastic force from the second elastic member 28.

Locking Assembly

As shown in FIGS. 1 to 9, the portable lighting apparatus 1 includes a locking assembly 41, a locking assembly 42, an operation member 43, and an operation member 44. The locking assembly 41 locks the first pole 31 to the guide pipe 2. The locking assembly 42 locks the second pole 32 to the first pole 31. The operation member 43 is operable to activate the locking assembly 41. The operation member 44 is operable to activate the locking assembly 42.

The user operates the operation member 43 to activate the locking assembly 41 to lock or unlock the first pole 31 to or from the guide pipe 2.

The user operates the operation member 44 to activate the locking assembly 42 to lock or unlock the second pole 32 to or from the first pole 31.

The user adjusts the position of the first pole 31 relative to the guide pipe 2 without the first pole 31 locked to the guide pipe 2, and then operates the operation member 43 to lock the first pole 31 to the guide pipe 2. The first pole 31 positioned relative to the guide pipe 2 is thus locked to the guide pipe 2.

The user adjusts the position of the second pole 32 relative to the first pole 31 without the second pole 32 locked to the first pole 31, and then operates the operation member 44 to lock the second pole 32 to the first pole 31. The second pole 32 positioned relative to the first pole 31 is thus locked to the first pole 31.

Figure 13:
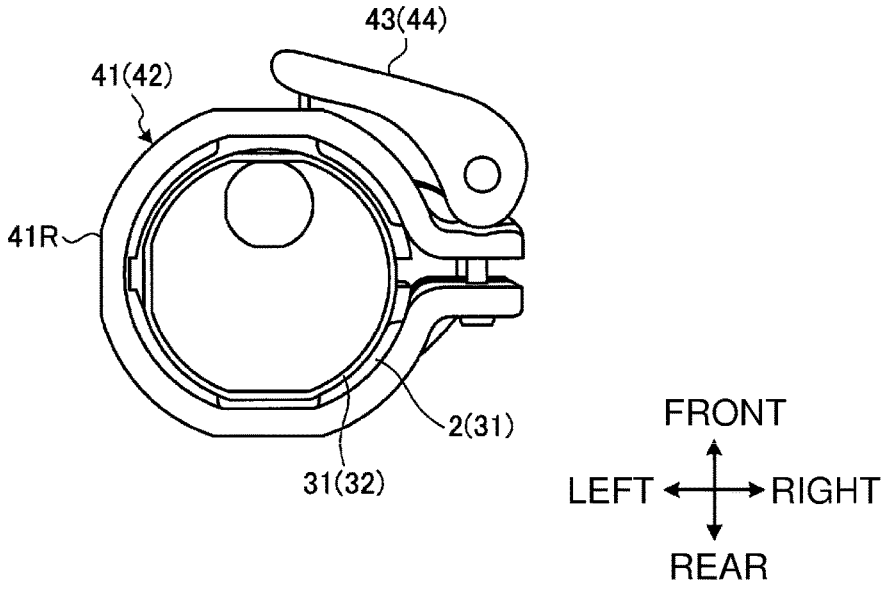
FIG. 13 is a view of a locking assembly in the embodiment.

FIG. 13 is a view of the locking assembly 41 in the embodiment. The locking assembly 41 includes an annular member 41R surrounding the guide pipe 2 and the first pole 31.

The annular member 41R is elastically deformable. The operation member 43 includes a pivotable lever to tighten the annular member 41R. When the operation member 43 pivots in a tightening direction, the first pole 31 is locked to the guide pipe 2. When the operation member 43 pivots in a loosening direction opposite to the tightening direction, the first pole 31 is unlocked from the guide pipe 2.

The locking assembly 42 and the operation member 44 have the same structure as the locking assembly 41 and the operation member 43, and will not be described.

As shown in FIGS. 1 to 9, the operation member 43 is between the first member 7 and the second member 9 vertically. The user thus places his or her hand between the first member 7 and the second member 9 and operates the operation member 43. The structure also reduces the likelihood of the user accidentally touching the operation member 43.

As shown in FIGS. 1 to 7, when the pole 3 is contracted, the operation member 44 is between the first member 7 and the second member 9 vertically. The user thus places his or her hand between the first member 7 and the second member 9 to operate the operation member 44. The structure also reduces the likelihood of the user accidentally touching the operation member 44 when the pole 3 is contracted. As shown in FIG. 8, the operation member 44 is located above the second member 9 when the pole 3 is extended.

The portable lighting apparatus 1 includes a locking assembly 50 and an operation member 53. The locking assembly 50 locks the collar 5 to the guide pipe 2. The operation member 53 is operable to activate the locking assembly 50.

Figure 14:
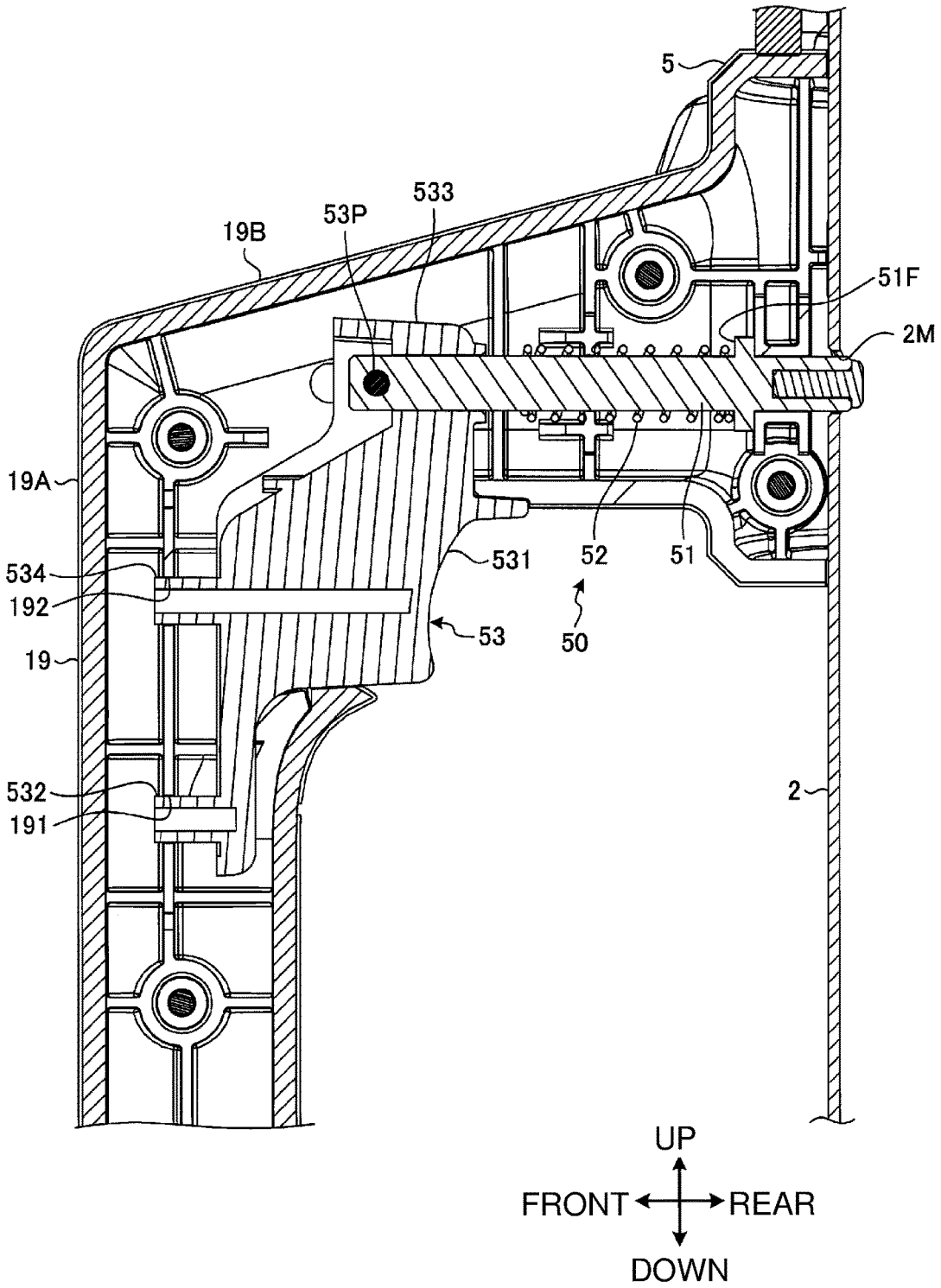
FIG. 14 is a sectional view of the locking assembly in the embodiment.

FIG. 14 is a sectional view of the locking assembly 50 in the embodiment. As shown in FIG. 14, the guide pipe 2 has openings 2M. The openings 2M are arranged at intervals vertically.

The locking assembly 50 is located at least in a portion of the collar 5. The locking assembly 50 includes a pin 51, and an elastic member 52 for applying an elastic force to the pin 51. The pin 51 can be placed in one opening 2M. The elastic member 52 generates an elastic force to force the pin 51 into the opening 2M. With the pin 51 placed in the opening 2M, the collar 5 is immovable relative to the guide pipe 2. With the pin 51 placed outside the opening 2M, the collar 5 is movable relative to the guide pipe 2. The position of the collar 5 relative to the guide pipe 2 is adjusted based on the opening 2M to receive the pin 51. The degree of opening of the legs 6 is adjusted based on the opening 2M to receive the pin 51.

The operation member 53 is operable to activate the locking assembly 50. The operation member 53 includes a switch. The operation member 53 is operable to unlock the collar 5 that is locked to the guide pipe 2 by the locking assembly 50. The locking assembly 50 is activated to unlock the collar 5 from the guide pipe 2.

The operation member 53 includes a pressing part 531, a first rod 532, a second rod 534, and a lever 533. The pressing part 531 partially protrudes rearward from the inner surface of the third handle 19. The user presses the pressing part 531. The third handle 19 accommodates a portion of the pressing part 531, the first rod 532, the second rod 534, and the lever 533 in its internal space.

The first rod 532 and the second rod 534 are arranged vertically. The first rod 532 and the second rod 534 protrude frontward from the pressing part 531. The first rod 532 is guided in the front-rear direction along a guide hole 191 in the third handle 19. The second rod 534 is guided in the front-rear direction along a guide hole 192 in the third handle 19. The operation member 53 is movable in the front-rear direction. The pin 51 is connected to the lever 533 with a pivot 53P.

The elastic member 52 surrounds the pin 51. The elastic member 52 extends between a flange 51F at the rear of pin 51 and the lever 533. The user operation on the operation member 53 includes pressing the pressing part 531. The operation member 53 being operated moves frontward, moving the pin 51 out of the opening 2M. This unlocks the collar 5 from the guide pipe 2. After the operation on the operation member 53 is stopped, the pin 51 enters the opening 2M with the elastic force from the elastic member 52. This locks the collar 5 to the guide pipe 2.

As shown in FIGS. 1, 4, 5, 6, 7, 8, and 14, the operation member 53 is located on the inner surface of the third handle 19 facing the guide pipe 2. The operation member 53 in the embodiment is located on the inner surface of the third handle 19 between the grip 19A and the arm 19B. The operation member 53 on the inner surface of the third handle 19 is operable with the fingers of the user gripping the third handle 19.

Light Emitter

Figure 15:
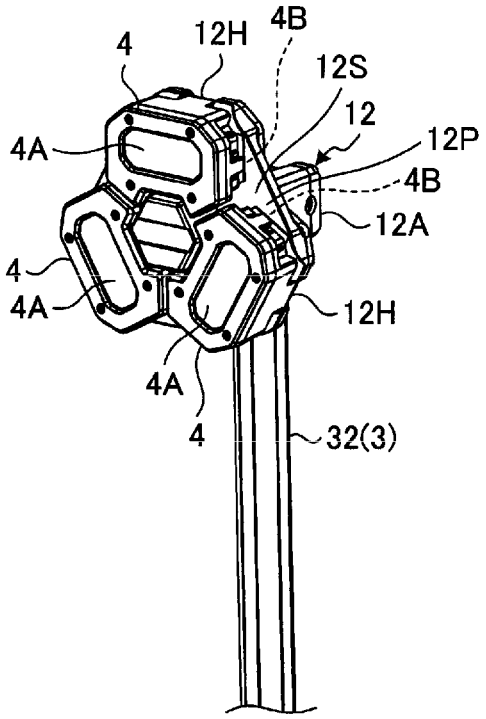
FIG. 15 is a front perspective view of light emitters in the embodiment.
Figure 16:
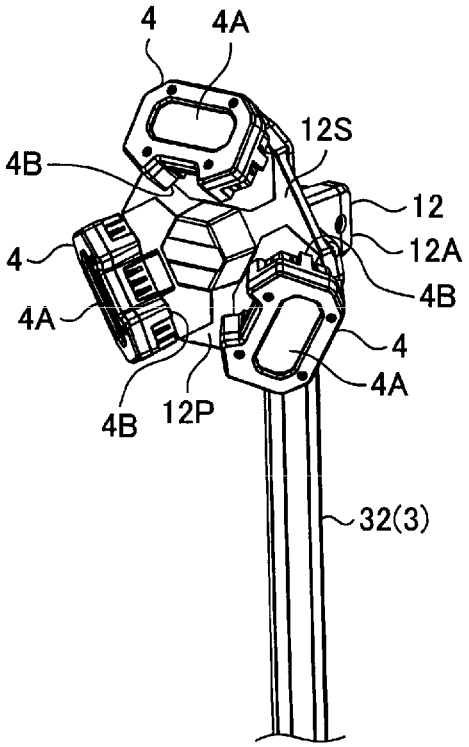
FIG. 16 is a front perspective view of the light emitters in the embodiment.

FIGS. 15 and 16 each are a front perspective view of the light emitters 4 in the embodiment. As shown in FIGS. 15 and 16, the support 12 supporting the light emitters 4 is located at the upper end of the second pole 32. The portable lighting apparatus 1 includes three light emitters 4 in the embodiment. The support 12 pivotally supports the light emitters 4.

The support 12 includes a plate 12P and a connector 12A. The plate 12P supports the light emitters 4. The connector 12A supports the plate 12P. The connector 12A is supported at the upper end of the second pole 32. The plate 12P is pivotally supported on the connector 12A. As the plate 12P pivots, the light emitters 4 supported on the plate 12P pivot together with the plate 12P.

The plate 12P pivotally supports the light emitters 4. The plate 12P includes hinges 12H that pivotally support the light emitters 4.

Each light emitter 4 includes a light emitting surface 4A and a back surface 4B. The light emitting surface 4A emits illumination light. The back surface 4B faces opposite to the light emitting surface 4A. The back surface 4B includes a surface of the housing of the light emitter 4. The back surface 4B emits no illumination light.

Each light emitter 4 can separately pivot relative to the plate 12P. As shown in FIG. 15, the light emitters 4 may pivot to have their light emitting surfaces 4A facing in the same direction. As shown in FIG. 16, the light emitters 4 may pivot to have their light emitting surfaces 4A each facing in a different direction.

As shown in FIG. 15, the plate 12P includes a support surface 12S, which faces the back surfaces 4B with the light emitters 4 pivoted to have their light emitting surfaces 4A facing in the same direction. With the light emitters 4 pivoted to have their light emitting surfaces 4A facing in the same direction, the back surfaces 4B are in contact with the support surface 12S. The light emitters 4 are located inside the edge of the support surface 12S. In other words, the light emitters 4 avoid protruding outside the edge of the support surface 12S with the light emitters 4 pivoted to have their light emitting surfaces 4A facing in the same direction.

With the back surfaces 4B in contact with the support surface 12S, the light emitters 4 remain stably at an angle. With the back surfaces 4B in contact with the support surface 12S, the light emitters 4 are less likely to change the angle when coming in contact with a surrounding object.

Carrying Manner

Figure 17:
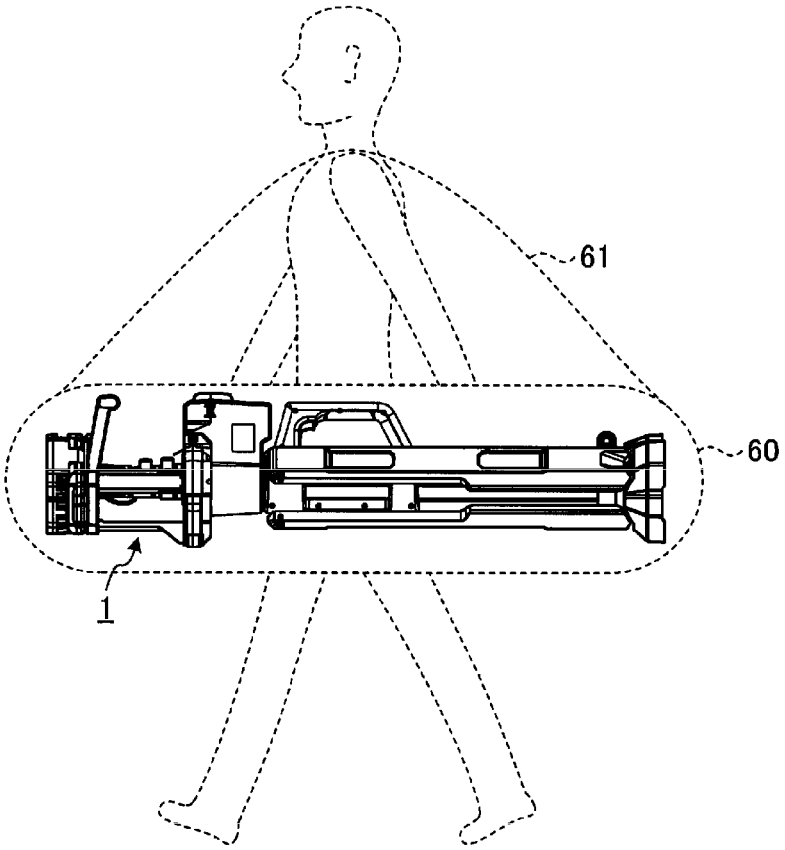
FIG. 17 is a schematic diagram describing carrying of the portable lighting apparatus according to the embodiment.
Figure 18:
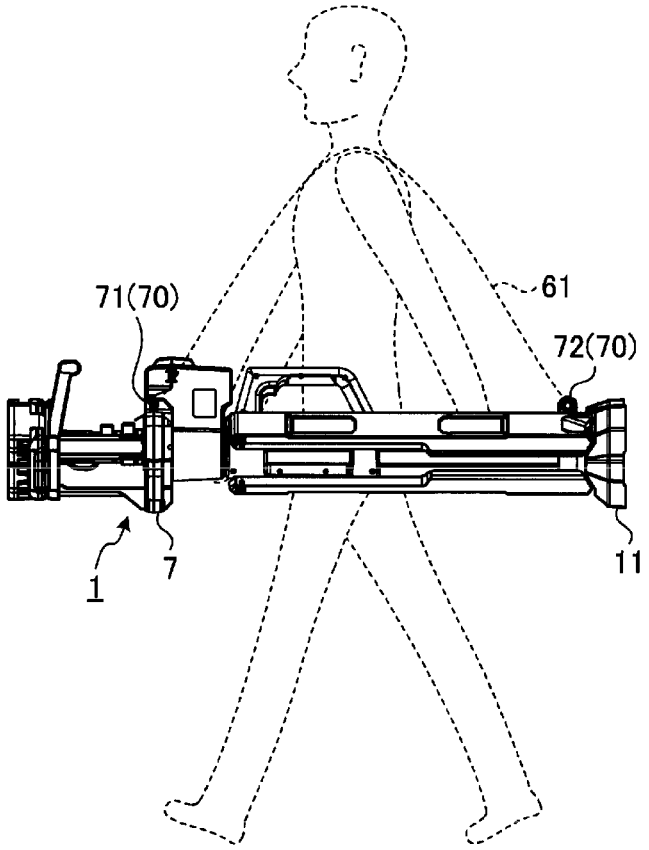
FIG. 18 is a schematic diagram describing carrying of the portable lighting apparatus according to the embodiment.

FIGS. 17 and 18 are schematic diagrams each describing carrying of the portable lighting apparatus 1 according to the embodiment.

As shown in FIG. 17, the user can carry the portable lighting apparatus 1 in a bag 60. A strap 61 is connected to the bag 60. The user can carry the bag 60 containing the portable lighting apparatus 1 with the strap 61 worn on the shoulder.

As shown in FIG. 18, the user can carry the portable lighting apparatus 1 with the strap 61 connected to the portable lighting apparatus 1. The strap 61 can be connected to the bag 60 and to the portable lighting apparatus 1. The user can carry the portable lighting apparatus 1 with the strap 61 worn on the shoulder.

In the embodiment, the first member 7 and the fourth member 11 each include a connector 70 to receive the strap 61. The connector 70 in the first member 7 has a hole 71. The connector 70 in the fourth member 11 has a hole 72.

The strap 61 has, at its one end, a hook to be placed through the hole 71. The strap 61 has, at its other end, a hook to be placed through the hole 72. This allows the user to wear the strap 61 on the shoulder to carry the portable lighting apparatus 1. The strap 61 connected to the portable lighting apparatus 1 can be connected to the bag 60 for efficient use of the strap 61.

In the embodiment described above, the first member 7 is located at the upper end of the guide pipe 2. The battery mount 8 is located at the first member 7. With the battery mount 8 at a higher position, the user can replace the battery 23 smoothly without, for example, crouching.

The battery mount 8 at the first member 7 adjusts the center of gravity of the portable lighting apparatus 1 to improve stability in the axial direction. The user can thus carry the portable lighting apparatus 1 smoothly.

The first member 7 includes the battery container 16 having the opening 24 to receive the battery 23. The battery mount 8 is inside the battery container 16. The battery mount 8 is thus protected by the battery container 16.

The first elastic member 27 moves the battery 23 accommodated in the battery container 16 out of the battery container 16 through the opening 24. With the battery 23 fixed to the battery mount 8, the release button 23B in the battery 23 is operated to release the battery 23 from to the battery mount 8. The battery 23 then springs up with the elastic force from the first elastic member 27. The battery 23 then at least partially protrudes from the opening 24. The user can easily grip the battery 23 detached from the battery mount 8.

The cover 25 closing the opening 24 reduces foreign objects entering the battery container 16.

The second elastic member 28 moves the cover 25 pivotally to close the opening 24. Under no external force acting on the cover 25, the cover 25 pivots with the elastic force from the second elastic member 28 to close the opening 24. The cover 25 thus closes the opening 24. This reduces foreign objects entering the battery container 16. When, for example, the user forgets to close the opening 24 with the cover 25, the opening 24 is closed by the cover 25 with the elastic force from the second elastic member 28.

The first member 7 includes the first base 14 surrounding the guide pipe 2 and the first handles 15 coupled to the first base 14. The user can grip the first handles 15 to carry the portable lighting apparatus 1.

The first handles 15 are coupled to the first portion of the first base 14 circumferentially about the central axis AX. The battery mount 8 and the battery container 16 are coupled to the second portion of the first base 14 opposite to the first portion circumferentially about the central axis AX. In the embodiment, the first handles 15 are located at the rear of the first base 14. The battery mount 8 and the battery container 16 are located at the front of the first base 14. The battery mount 8 and the first handles 15 are at different positions without interfering with each other. The user can attach and detach the battery 23 smoothly and can grip the first handles 15 smoothly.

The second member 9 is located above the first member 7 and surrounds the pole 3. The user can grip the second member 9, in addition to the first member 7.

The second member 9 includes the second base 17 surrounding the pole 3 and the second handle 18 coupled to the second base 17. The user can grip the second handle 18 to carry the portable lighting apparatus 1.

The second handle 18 is located above the battery mount 8. The second handle 18 is located at the front of the portable lighting apparatus 1, and the first handles 15 are located at the rear of the portable lighting apparatus 1. The user can thus grip the first handles 15 with one hand and the second handle 18 with the other hand to carry the portable lighting apparatus 1.

The first member 7 and the second member 9 are connected to each other with the third members 10, and are restricted from moving relative to each other.

The third members 10 are at intervals to surround the guide pipe 2. The third members 10 thus serve as handles.

The locking assembly 41 locks the pole 3 to the guide pipe 2. The operation member 43 is operable to activate the locking assembly 41. The operation member 43 is between the first member 7 and the second member 9. The user places his or her hand between the first member 7 and the second member 9 and operates the operation member 43. The operation member 43 between the first member 7 and the second member 9 reduces the likelihood of the user accidentally touching the operation member 43.

The fourth member 11 is located at the lower end of the guide pipe 2. The stays 21 are pivotally connected to the fourth member 11 and to the respective legs 6. The stays 21 move the legs 6 between the closed position and the open position with the collar 5 moving relative to the guide pipe 2. The third handle 19 is coupled to the collar 5. The user can move the collar 5 relative to the guide pipe 2 while gripping the third handle 19 to move the legs 6 between the open position and the closed position. The user can grip the third handle 19 to carry the portable lighting apparatus 1.

The locking assembly 50 locks the collar 5 to the guide pipe 2. The operation member 53 is operable to activate the locking assembly 50. The operation member 53 is located on the inner surface of the third handle 19 facing the guide pipe 2. The user gripping the third handle 19 can operate the operation member 53 with, for example, the forefinger. The user gripping the third handle 19 can unlock the collar 5 from the guide pipe 2.

The first member 7 and the fourth member 11 each include the connector 70 to receive the strap 61. The user can connect the strap 61 to the connectors 70 to carry the portable lighting apparatus 1 smoothly.

The first member 7 includes the operation device 22 operable to adjust the light emitters 4. The operation device 22 at a small distance to the battery mount 8 is connected to the battery mount 8 with a shorter cable.

The light emitters 4 are pivotally supported on the support 12 located at the upper end of the pole 3. The light emitters 4 pivot to adjust the direction in which illumination light is emitted. The support 12 includes the support surface 12S that faces the back surfaces 4B with the light emitters 4 pivoted to have their light emitting surfaces 4A facing in the same direction. The light emitters 4 thus remain stably at an angle. The light emitters 4 are thus less likely to change the angle when coming in contact with a surrounding object.

Light Emitter in Modification

Figure 19:
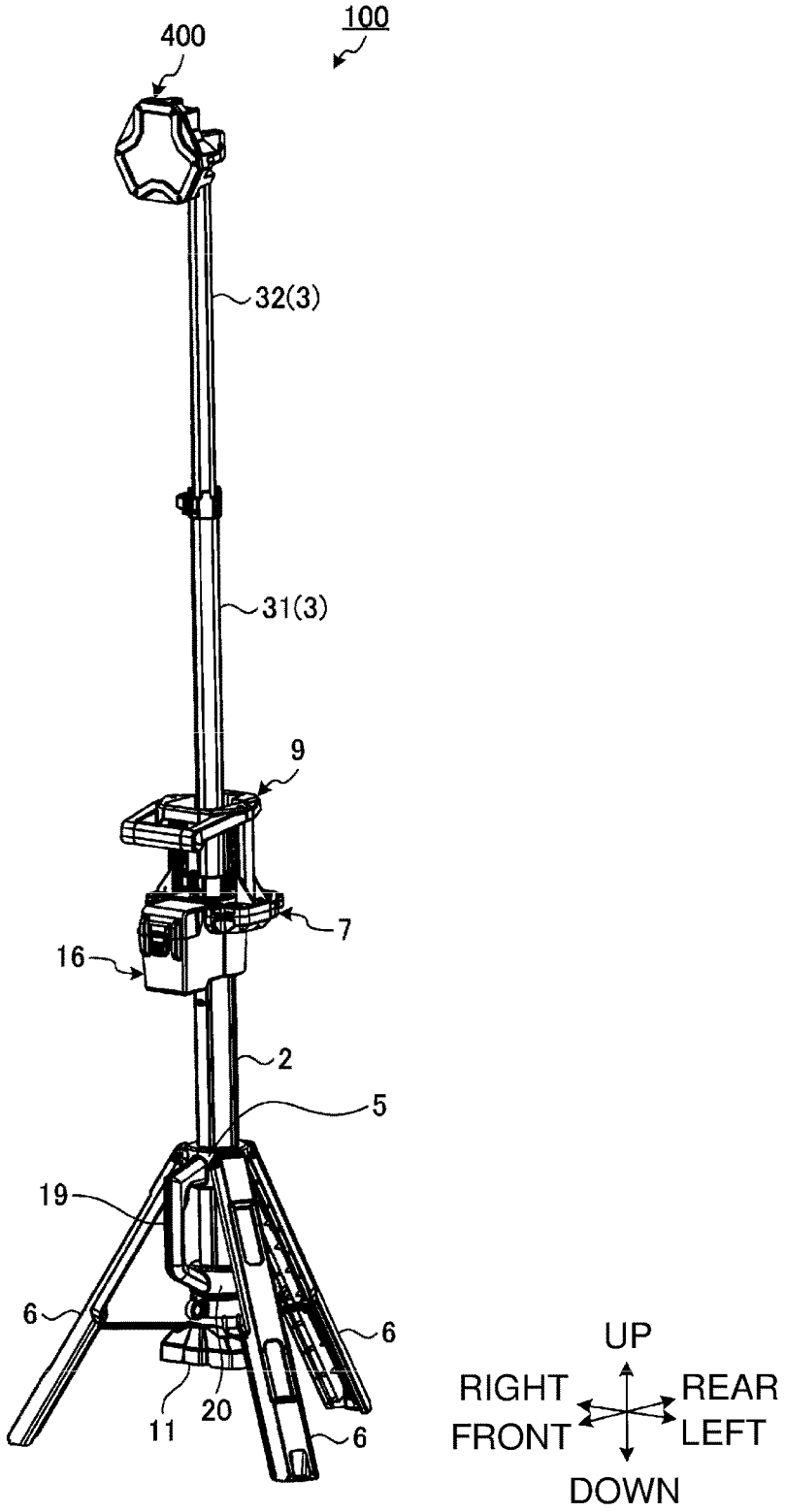
FIG. 19 is a front perspective view of a portable lighting apparatus according to a modification.

FIG. 19 is a front perspective view of a portable lighting apparatus 100 according to a modification. The portable lighting apparatus 100 includes a light emitter 400. As shown in FIG. 19, the light emitter 400 may be a single light emitter.

Locking Assembly in First Modification

Figure 20:
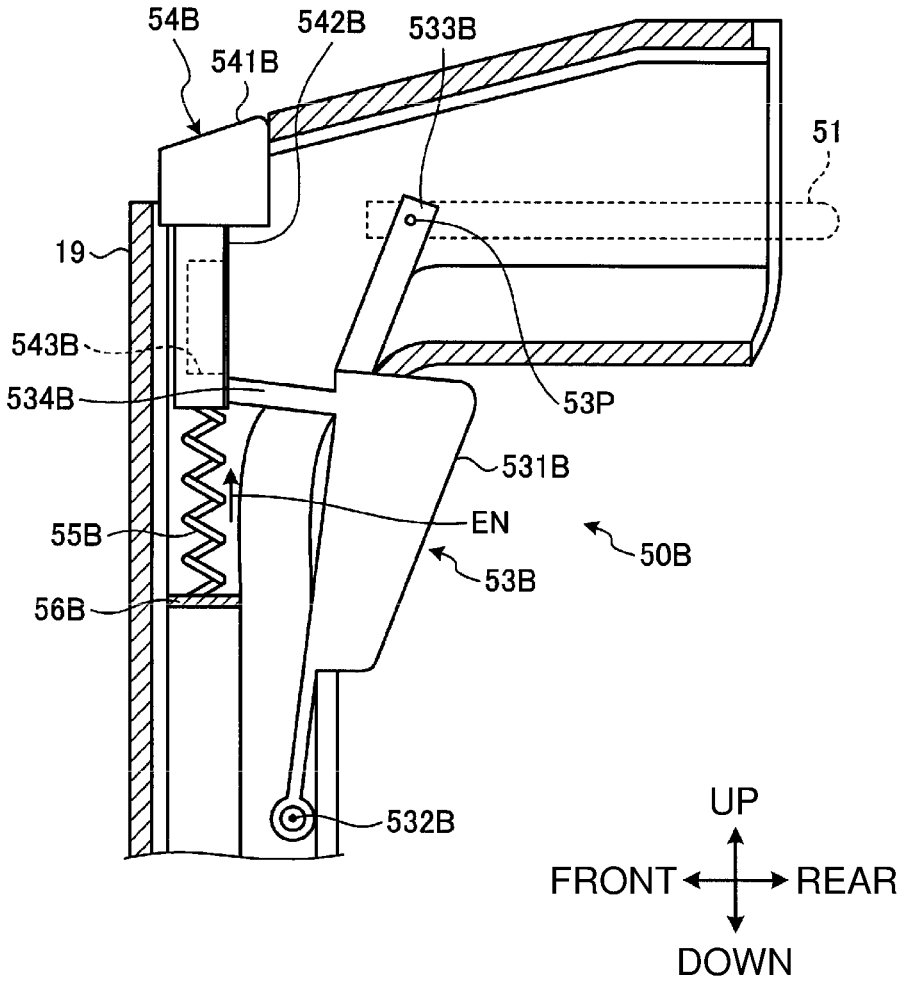
FIG. 20 is a sectional view of a locking assembly in a first modification.
Figure 21:
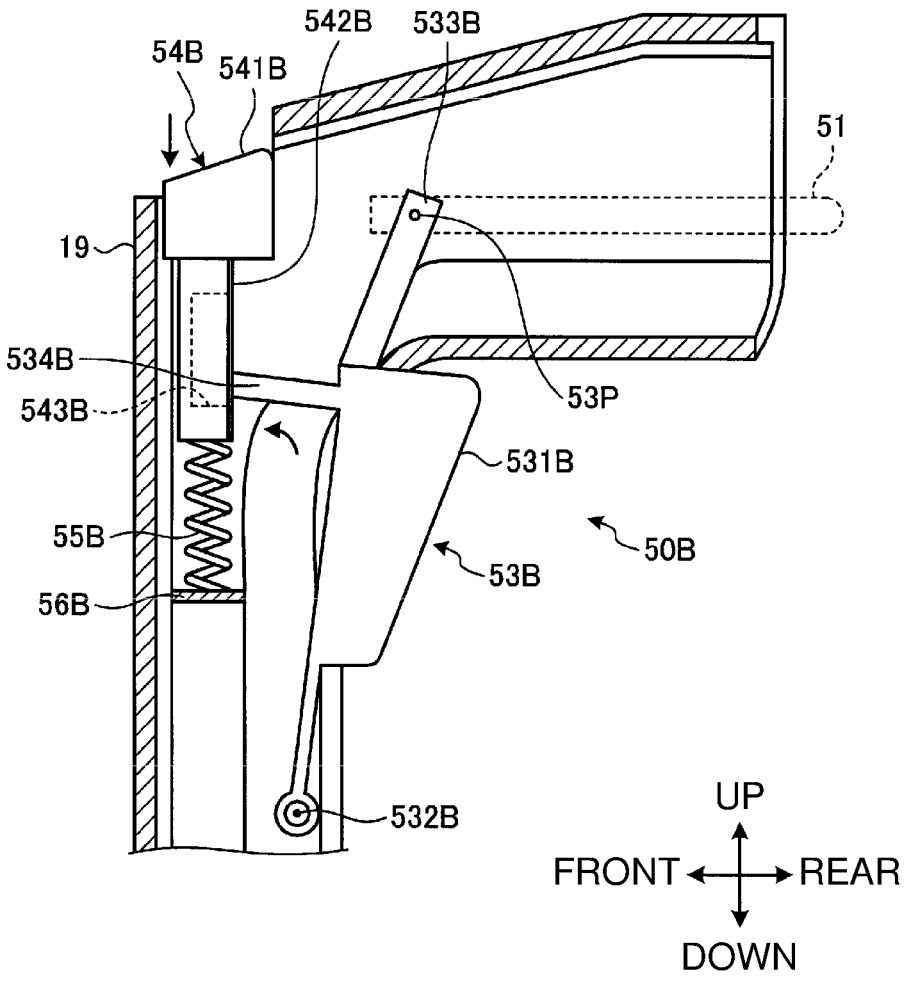
FIG. 21 is a sectional view of the locking assembly in the first modification.

FIGS. 20 and 21 each are a sectional view of a locking assembly 50B in a first modification. The locking assembly 50B locks the collar 5 to the guide pipe 2. An operation member 53B is located at the third handle 19. The operation member 53B is operable to activate the locking assembly 50B.

The operation member 53B includes a pressing part 531B, a pivot 532B, a first lever 533B, and a second lever 534B. The pressing part 531B partially protrudes rearward from the inner surface of the third handle 19. The user can press the pressing part 531B. The third handle 19 accommodates a portion of the pressing part 531B, the pivot 532B, the first lever 533B, and the second lever 534B in its internal space. The pressing part 531B is connected to the third handle 19 with the pivot 532B. The pressing part 531B is pivotable about the pivot 532B. The pin 51 is connected to the first lever 533B with the pivot 53P.

In the same manner as in the above embodiment, the pin 51 is surrounded by the elastic member 52. The pin 51 can be placed in one opening 2M in the guide pipe 2. In FIGS. 20 and 21, the elastic member 52 and the guide pipe 2 are not shown. As the pressing part 531B is pressed, the first lever 533B moves frontward, thus moving the pin 51 out of the opening 2M. When the pressing part 531B is released of pressing, the pin 51 enters the opening 2M with the elastic force from the elastic member 52.

The third handle 19 includes an unlock button 54B and an elastic member 55B. The unlock button 54B is supported on the third handle 19. The unlock button 54B is movable vertically within a defined movable range. The unlock button 54B includes a pressing part 541B and a locking part 542B. The pressing part 541B partially protrudes upward from the upper surface of the third handle 19. The user can press the pressing part 541B. The third handle 19 accommodates a portion of the pressing part 541B and the locking part 542B in its internal space. The locking part 542B protrudes downward from the pressing part 541B. The locking part 542B comes in contact with the second lever 534B on the operation member 53B. The second lever 534B protrudes frontward from the pressing part 531B. The locking part 542B has a recess 543B that receives the second lever 534B.

The elastic member 55B is located in the internal space of the third handle 19. The elastic member 55B is a coil spring extending between a retainer 56B located in the internal space of the third handle 19 and the lower end of the locking part 542B. As indicated by an arrow EN in FIG. 20, the elastic member 55B generates an elastic force to move the unlock button 54B upward.

The user operation on the unlock button 54B includes pressing the pressing part 541B. In FIG. 20, the unlock button 54B is not operated. In this state, the unlock button 54B is located at the upper end of the movable range of the unlock button 54B with the elastic force from the elastic member 55B. With the unlock button 54B at the upper end of the movable range, the second lever 534B is outside the recess 543B and is in contact with a surface (rear surface) of the locking part 542B. With the second lever 534B in contact with the surface of the locking part 542B, the operation member 53B is immovable when the pressing part 531B is pressed by the user.

In FIG. 21, the unlock button 54B is operated. As shown in FIG. 21, when the user presses the pressing part 541B downward, the locking part 542B moves downward. The recess 543B faces the second lever 534B. When the user presses the pressing part 531B in this state, the second lever 534B is received in the recess 543B. In other words, pressing the pressing part 541B downward allows the operation member 53B to move (pivot) frontward.

To move the operation member 53B, as described above, the unlock button 54B is to be operated before the operation member 53B is operated. The user can operate the operation member 53B after operating the unlock button 54B. Without operating the unlock button 54B, the user cannot operate the operation member 53B. Although, for example, the user may accidentally touch the operation member 53B while carrying the portable lighting apparatus 1, the locking assembly 50B avoids being activated unless the unlock button 54B is operated. More specifically, unless both the unlock button 54B and the operation member 53B are operated, the locking assembly 50B does not unlock the collar 5 from the guide pipe 2. The user can activate the locking assembly 50B by pressing the operation member 53B while pressing the unlock button 54B with, for example, a thumb. In other words, operating both the unlock button 54B and the operation member 53B unlocks the guide pipe 2 and the collar 5 locked by the locking assembly 50B.

Locking Assembly in Second Modification

Figure 22:
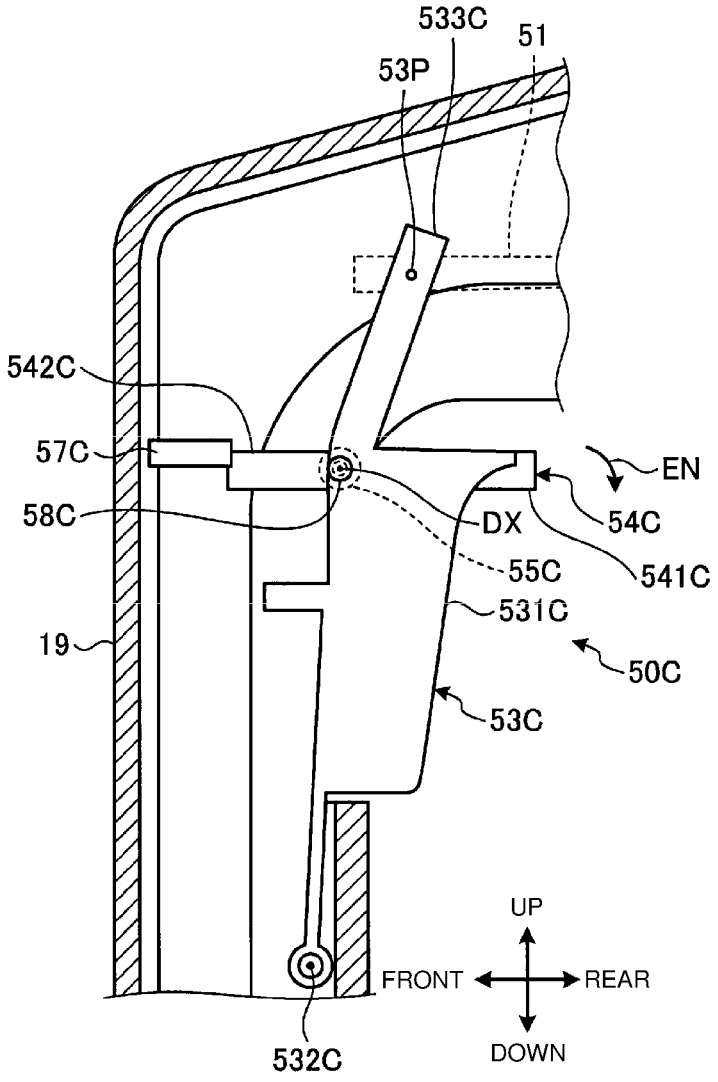
FIG. 22 is a sectional view of a locking assembly in a second modification.
Figure 23:
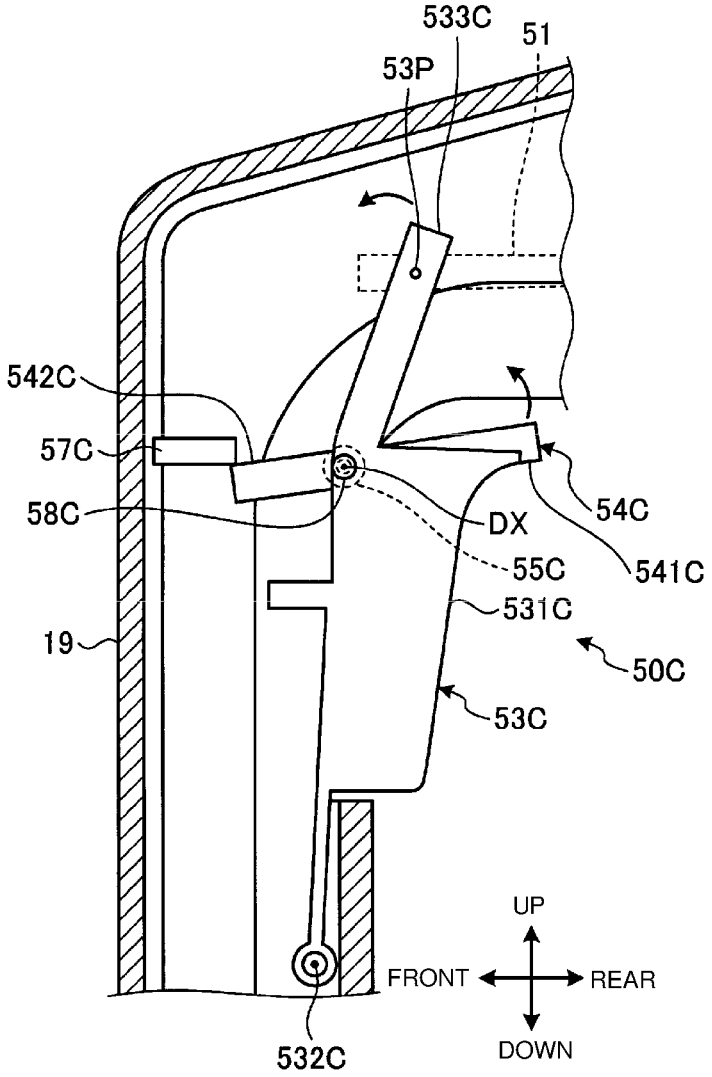
FIG. 23 is a sectional view of the locking assembly in the second modification.

FIGS. 22 and 23 each are a sectional view of a locking assembly 50C in a second modification. The locking assembly 50C locks the collar 5 to the guide pipe 2. An operation member 53C is located at the third handle 19. The operation member 53C is operable to activate the locking assembly 50C.

The operation member 53C includes a pressing part 531C, a pivot 532C, and a first lever 533C. The pressing part 531C partially protrudes rearward from the inner surface of the third handle 19. The user can press the pressing part 531C. The third handle 19 accommodates a portion of the pressing part 531C, the pivot 532C, and the first lever 533C in its internal space. The pressing part 531C is connected to the third handle 19 with the pivot 532C. The pressing part 531C is pivotable about the pivot 532C. The pin 51 is connected to the first lever 533C with the pivot 53P.

In the same manner as in the above embodiment, the pin 51 is surrounded by the elastic member 52. The pin 51 can be placed in one opening 2M in the guide pipe 2. In FIGS. 22 and 23, the elastic member 52 and the guide pipe 2 are not shown. As the pressing part 531C is pressed, the first lever 533C moves frontward, thus moving the pin 51 out of the opening 2M. When the pressing part 531C is released of pressing, the pin 51 enters the opening 2M with the elastic force from the elastic member 52.

The third handle 19 includes an unlock button 54C and an elastic member 55C. The unlock button 54C is connected to the operation member 53C with a hinge 58C. The unlock button 54C is pivotable about a pivot shaft DX of the hinge 58C. The unlock button 54C includes a pressing part 541C and a locking part 542C. The pressing part 541C partially protrudes rearward from the inner surface of the third handle 19. The user can press the pressing part 541C. The third handle 19 accommodates a portion of the pressing part 541C and the locking part 542C in its internal space. The locking part 542C protrudes frontward from the pressing part 541C. The locking part 542C comes in contact with a retainer 57C located in the internal space of the third handle 19.

The elastic member 55C is located in the internal space of the third handle 19. The elastic member 55C is a torsion spring located at the hinge 58C. As indicated by an arrow EN in FIG. 22, the elastic member 55C generates an elastic force to cause the pressing part 541C in the unlock button 54C to move downward.

In FIG. 22, the unlock button 54C is not operated. In this state, the unlock button 54C pivots in a direction indicated by the arrow EN with the elastic force from the elastic member 55C. This causes the locking part 542C to come in contact with the retainer 57C. With the locking part 542C in contact with the retainer 57C, the operation member 53C is immovable when the pressing part 531C is pressed by the user.

In FIG. 23, the unlock button 54C is operated. As shown in FIG. 23, when the user presses the pressing part 541C upward, the locking part 542C moves downward. This separates the locking part 542C from the retainer 57C. With the locking part 542C separated from the retainer 57C, the user presses the pressing part 531C. The locking part 542C then moves frontward in the space below the retainer 57C. In other words, pressing the pressing part 541C upward allows the operation member 53C to move (pivot) frontward.

To move the operation member 53C, as described above, the unlock button 54C is to be operated before the operation member 53C is operated. The user can operate the operation member 53C after operating the unlock button 54C.

Locking Assembly in Third Modification

Figure 24:
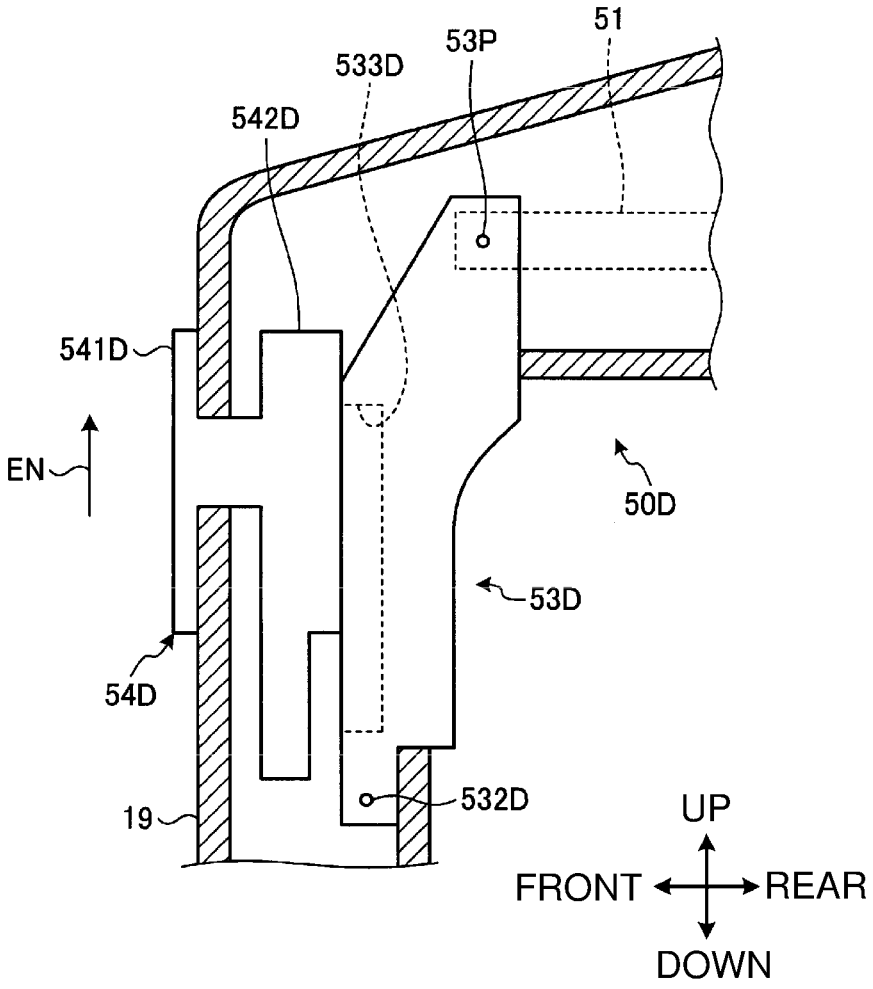
FIG. 24 is a sectional view of a locking assembly in a third modification.
Figure 25:
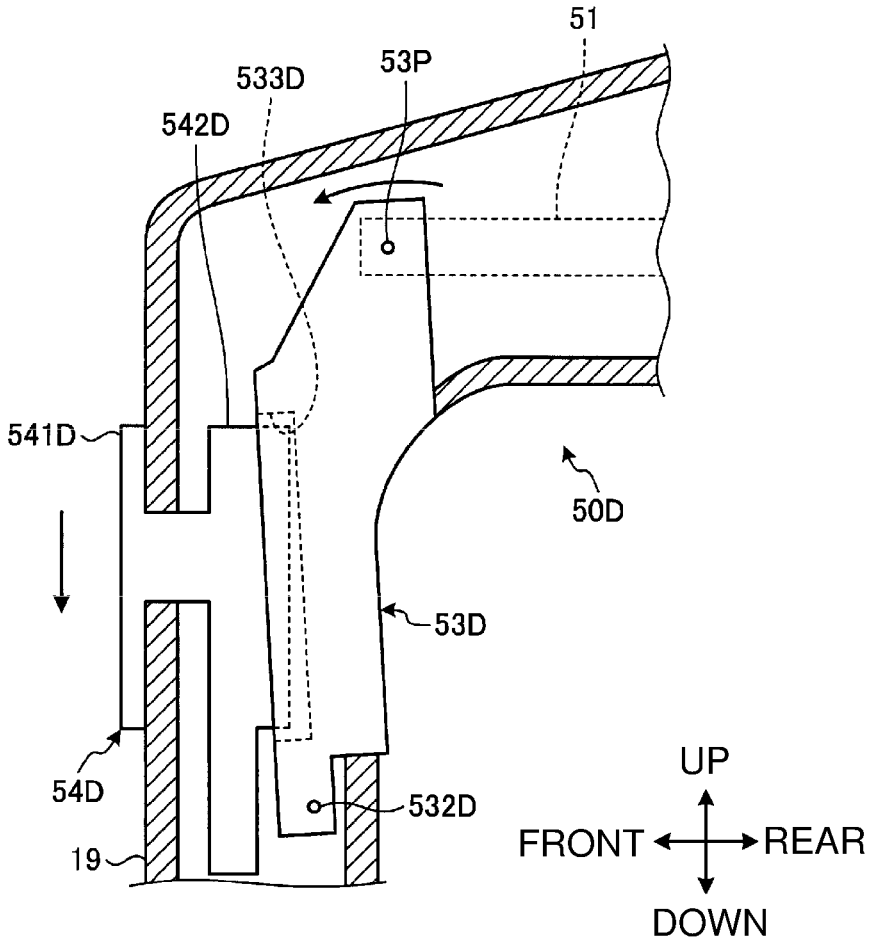
FIG. 25 is a sectional view of the locking assembly in the third modification.

FIGS. 24 and 25 each are a sectional view of a locking assembly 50D in a third modification. The locking assembly 50D locks the collar 5 to the guide pipe 2. An operation member 53D is located at the third handle 19. The operation member 53D is operable to activate the locking assembly 50D.

The operation member 53D partially protrudes rearward from the inner surface of the third handle 19. The operation member 53D is partially placed in the internal space of the third handle 19. The operation member 53D is connected to the third handle 19 with a pivot 532D. The operation member 53D is pivotable about the pivot 532D. The pin 51 is connected to the operation member 53D with the pivot 53P.

In the same manner as in the above embodiment, the pin 51 is surrounded by the elastic member 52. The pin 51 can be placed in one opening 2M in the guide pipe 2. In FIGS. 24 and 25, the elastic member 52 and the guide pipe 2 are not shown. Pressing the operation member 53D moves the pin 51 out of the opening 2M. When the operation member 53D is released of pressing, the pin 51 enters the opening 2M with the elastic force from the elastic member 52.

The third handle 19 includes an unlock button 54D. The unlock button 54D is supported on the third handle 19. The unlock button 54D is movable vertically within a defined movable range. The unlock button 54D is supported on the third handle 19 in a vertically slidable manner.

The unlock button 54D includes an operation part 541D and a locking part 542D. The operation part 541D is located on the front surface of the third handle 19. The user can slide the operation part 541D vertically. The locking part 542D is located in the internal space of the third handle 19. The locking part 542D comes in contact with the operation member 53D. The unlock button 54D is connected to an elastic member (not shown). As indicated by an arrow EN in FIG. 24, the elastic member generates an elastic force to move the unlock button 54D upward.

The operation member 53D has a recess 533D receiving at least a portion of the unlock button 54D. The recess 533D is located on the front surface of the operation member 53D. The locking part 542D is at least partially receivable in the recess 533D.

In FIG. 24, the unlock button 54D is not operated. In this state, the unlock button 54D moves in a direction indicated by the arrow EN with the elastic force from the elastic member. The locking part 542D is thus in contact with the front surface of the operation member 53D. The operation member 53D is locked to the third handle 19 with the locking part 542D. With the locking part 542D in contact with the front surface of the operation member 53D, the operation member 53D is immovable when pressed by the user.

In FIG. 25, the unlock button 54D is operated. As shown in FIG. 25, when the user slides the unlock button 54D downward, the locking part 542D slides downward. This causes the locking part 542D to face the recess 533D. When the user presses the operation member 53D in this state, the locking part 542D is received in the recess 533D. In other words, the operation member 53D pressed frontward is movable (pivotable) frontward.

To move the operation member 53D, as described above, the unlock button 54D is to be operated before the operation member 53D is operated. The user can operate the operation member 53D after operating the unlock button 54D.

REFERENCE SIGNS LIST

1 portable lighting apparatus
2 guide pipe
2M opening
3 pole
4 light emitter
4A light emitting surface
4B back surface
5 collar
6 leg
7 first member
8 battery mount
8T connector terminal
9 second member
10 third member
11 fourth member
12 support
12A connector
12H hinge
12P plate
12S support surface
13 hinge
14 first base
14M opening
15 first handle
16 battery container
17 second base
17M opening
18 second handle
18A grip
18B arm
18C arm
19 third handle
19A grip
19B arm
19C arm
20 collar
21 stay
22 operation device
22A on-off switch
22B light amount adjustment switch
23 battery
23B release button
24 opening
25 cover
26 fastener
27 first elastic member
28 second elastic member
29 support plate
31 first pole
32 second pole
33 hinge
41 locking assembly (first locking assembly)
41R annular member
42 locking assembly
43 operation member (first operation member)
44 operation member
50 locking assembly (second locking assembly)
51 pin
51F flange
52 elastic member
53 operation member (second operation member)
60 bag
61 strap
70 connector
71 hole
72 hole
100 portable lighting apparatus
400 light emitter
AX central axis

What is claimed is:

1. A portable lighting apparatus, comprising:

a guide pipe;

a pole supported on the guide pipe in a manner movable in a vertical direction parallel to a central axis of the guide pipe;

at least one light emitter at an upper end of the pole;

a collar surrounding the guide pipe;

a plurality of legs pivotally connected to the collar;

a first member at an upper end of the guide pipe, the first member including a battery container having an opening to receive a battery, a first base surrounding the guide pipe, and a first handle coupled to the first base;

a second member above the first member and surrounding the pole, the second member including a second base surrounding the pole, and a second handle coupled to the second base;

at least one third member connecting the first member and the second member; and a battery mount located at the first member inside the battery container.

2. The portable lighting apparatus according to claim 1, wherein the first member includes a first elastic member configured to apply an elastic force to the battery and cause the battery to protrude from the battery container.

3. The portable lighting apparatus according to claim 1, wherein the first member includes a cover pivotally connected to the first member to close the opening.

4. The portable lighting apparatus according to claim 3, wherein the first member includes a second elastic member configured to apply an elastic force to the cover to close the opening.

5. The portable lighting apparatus according to claim 1, wherein the first handle is coupled to a first portion of the first base circumferentially about the central axis, and the battery mount is coupled to a second portion of the first base opposite to the first portion circumferentially about the central axis.

6. The portable lighting apparatus according to claim 1, wherein the second handle is above the battery mount.

7. The portable lighting apparatus according to claim 1, wherein the at least one third member includes a plurality of third members at intervals surrounding the guide pipe.

8. The portable lighting apparatus according to claim 1, further comprising:

a first locking assembly configured to lock the pole to the guide pipe; and a first operation member operable to activate the first locking assembly, the first operation member being between the first member and the second member.

9. The portable lighting apparatus according to claim 1, further comprising:

a fourth member at a lower end of the guide pipe;

a plurality of stays each pivotally connected to a corresponding leg of the plurality of legs and to the fourth member, the plurality of stays being configured to move the plurality of legs between an open position and a closed position with the collar moving relative to the guide pipe; and a third handle coupled to the collar.

10. The portable lighting apparatus according to claim 9, further comprising:

a second locking assembly configured to lock the collar to the guide pipe; and a second operation member operable to activate the second locking assembly, the second operation member being on an inner surface of the third handle facing the guide pipe.

11. The portable lighting apparatus according to claim 9, wherein the first member and the fourth member each include a connector to receive a strap.

12. The portable lighting apparatus according to claim 1, wherein the first member includes an operation device operable to adjust the at least one light emitter.

13. The portable lighting apparatus according to claim 1, further comprising:

a plurality of the light emitters; and a support at the upper end of the pole, the support pivotally supporting the plurality of light emitters, wherein the plurality of light emitters each have a light emitting surface and a back surface facing opposite to the light emitting surface, and the support includes a support surface facing the back surface of each of the plurality of light emitters with the plurality of light emitters each pivoted to have the light emitting surface facing in a direction.

* * * * *